US009037323B2

(12) United States Patent
Kumar et al.

(10) Patent No.: US 9,037,323 B2
(45) Date of Patent: May 19, 2015

(54) METHOD AND APPARATUS FOR LIMITING IN-TRAIN FORCES OF A RAILROAD TRAIN

(75) Inventors: Ajith Kuttannair Kumar, Erie, PA (US); James D. Brooks, Erie, PA (US)

(73) Assignee: General Electric Company, Schenectady, NY (US)

( * ) Notice: Subject to any disclaimer, the term of this patent is extended or adjusted under 35 U.S.C. 154(b) by 1757 days.

(21) Appl. No.: 11/742,568

(22) Filed: Apr. 30, 2007

(65) Prior Publication Data

US 2008/0128562 A1 Jun. 5, 2008

Related U.S. Application Data

(60) Provisional application No. 60/868,240, filed on Dec. 1, 2006.

(51) Int. Cl.

| | |
|---|---|
| ***B61C 17/00*** | (2006.01) |
| ***B61C 17/12*** | (2006.01) |
| ***B61L 3/00*** | (2006.01) |

(52) U.S. Cl.

CPC *B61C 17/12* (2013.01); *B61L 3/006* (2013.01)

(58) Field of Classification Search

USPC ..... 701/19, 20; 246/186, 182 R, 182 B, 1 R, 246/167 R

See application file for complete search history.

(56) References Cited

U.S. PATENT DOCUMENTS

| | | | | |
|---|---|---|---|---|
| 3,519,805 | A | | 7/1970 | Thorne-Booth |
| 3,650,216 | A | | 3/1972 | Harwick et al. |
| 3,655,962 | A | | 4/1972 | Koch |
| 3,865,042 | A | | 2/1975 | DePaola et al. |
| 3,905,012 | A | * | 9/1975 | Vrabel et al. ..... 246/167 D |
| 4,005,838 | A | | 2/1977 | Grundy |
| 4,041,283 | A | * | 8/1977 | Mosier ..... 701/20 |
| 4,042,810 | A | | 8/1977 | Mosher |
| 4,181,943 | A | | 1/1980 | Mercer, Sr. |
| 4,253,399 | A | | 3/1981 | Spigarelli |
| 4,279,395 | A | | 7/1981 | Boggio et al. |
| 4,344,364 | A | | 8/1982 | Nickles et al. |
| 4,401,035 | A | | 8/1983 | Spigarelli et al. |
| 4,561,057 | A | | 12/1985 | Haley, Jr. et al. |
| 4,582,280 | A | | 4/1986 | Nichols et al. |

(Continued)

FOREIGN PATENT DOCUMENTS

| | | |
|---|---|---|
| CN | 101535114 B | 6/2012 |
| EP | 1 136 969 | 9/2001 |

(Continued)

OTHER PUBLICATIONS

Peppard, L.E. et al., "Localized Feedback Controls for Multi-Locomotive Powered Trains", 1973 IEEE Conference on Decision and Control, 12th Symposium on Adaptive Processes, Queen's University, Ontario, pp. 491-496 Dec. 1973.

*Primary Examiner* — Thomas G Black
*Assistant Examiner* — Ana Thomas
(74) *Attorney, Agent, or Firm* — GE Global Patent Operation; John A. Kramer

(57) ABSTRACT

An apparatus for operating a railway system, the railway system comprising a lead vehicle consist, a non-lead vehicle consist and railcars, the apparatus including a first element for determining a slack condition of railway system segments, wherein the segments are delineated by nodes, and a control element configured to control an application of tractive effort or braking effort of the lead vehicle consist or the non-lead vehicle consist.

76 Claims, 8 Drawing Sheets

(56) References Cited

U.S. PATENT DOCUMENTS

| | | | | |
|---|---|---|---|---|
| 4,602,335 | A | 7/1986 | Perlmutter | |
| 4,711,418 | A | 12/1987 | Aver, Jr. et al. | |
| 4,735,385 | A | 4/1988 | Nickles et al. | |
| 4,794,548 | A | 12/1988 | Lynch et al. | |
| 4,827,438 | A | 5/1989 | Nickles et al. | |
| 4,853,883 | A | 8/1989 | Nickles et al. | |
| 5,109,343 | A | 4/1992 | Budway | |
| 5,398,894 | A | 3/1995 | Pascoe | |
| 5,437,422 | A | 8/1995 | Newman | |
| 5,440,489 | A | 8/1995 | Newman | |
| 5,676,059 | A | 10/1997 | Alt | |
| 5,720,455 | A | 2/1998 | Klemanski et al. | |
| 5,738,311 | A | 4/1998 | Fernandez | |
| 5,740,547 | A | 4/1998 | Kull et al. | |
| 5,744,707 | A | 4/1998 | Kull | |
| 5,758,299 | A | 5/1998 | Sandborg et al. | |
| 5,785,392 | A | 7/1998 | Hart | |
| 5,813,635 | A | 9/1998 | Fernandez | |
| 5,820,226 | A | 10/1998 | Hart | |
| 5,828,979 | A | 10/1998 | Polivka et al. | |
| 5,833,325 | A | 11/1998 | Hart | |
| 5,927,822 | A | 7/1999 | Hart | |
| 5,934,764 | A | 8/1999 | Dimsa et al. | |
| 5,950,967 | A | 9/1999 | Montgomery | |
| 5,969,643 | A | 10/1999 | Curtis | |
| 5,978,718 | A | 11/1999 | Kull | |
| 5,986,577 | A | 11/1999 | Bezos | |
| 5,986,579 | A | 11/1999 | Halvorson | |
| 5,995,881 | A | 11/1999 | Kull | |
| 6,112,142 | A | 8/2000 | Shockley et al. | |
| 6,114,974 | A | 9/2000 | Halvorson | |
| 6,125,311 | A | 9/2000 | Lo | |
| 6,128,558 | A | 10/2000 | Kernwein | |
| 6,144,901 | A | 11/2000 | Nickles et al. | |
| 6,163,089 | A | 12/2000 | Kull | |
| 6,216,095 | B1 | 4/2001 | Glista | |
| 6,219,595 | B1 * | 4/2001 | Nickles et al. | 701/19 |
| 6,269,034 | B1 | 7/2001 | Shibuya | |
| 6,273,521 | B1 * | 8/2001 | Halvorson et al. | 303/7 |
| 6,275,165 | B1 | 8/2001 | Bezos | |
| 6,308,117 | B1 | 10/2001 | Ryland et al. | |
| 6,322,025 | B1 | 11/2001 | Colbert et al. | |
| 6,353,780 | B1 * | 3/2002 | Hart | 701/20 |
| 6,360,998 | B1 | 3/2002 | Halvorson et al. | |
| 6,377,215 | B1 | 4/2002 | Halvorson et al. | |
| 6,487,488 | B1 | 11/2002 | Peterson, Jr. et al. | |
| 6,505,103 | B1 | 1/2003 | Howell et al. | |
| 6,516,727 | B2 | 2/2003 | Kraft | |
| 6,591,758 | B2 | 7/2003 | Kumar | |
| 6,609,049 | B1 | 8/2003 | Kane et al. | |
| 6,612,245 | B2 | 9/2003 | Kumar et al. | |
| 6,612,246 | B2 | 9/2003 | Kumar | |
| 6,615,118 | B2 | 9/2003 | Kumar | |
| 6,622,068 | B2 * | 9/2003 | Hawthorne | 701/19 |
| 6,631,322 | B1 * | 10/2003 | Arthur et al. | 701/211 |
| 6,691,957 | B2 | 2/2004 | Hess, Jr. et al. | |
| 6,694,231 | B1 | 2/2004 | Rezk | |
| 6,732,023 | B2 | 5/2004 | Sugita et al. | |
| 6,760,712 | B1 * | 7/2004 | Bonissone et al. | 706/4 |
| 6,763,291 | B1 | 7/2004 | Houpt et al. | |
| 6,782,044 | B1 | 8/2004 | Wright et al. | |
| 6,789,005 | B2 | 9/2004 | Hawthorne | |
| 6,810,312 | B2 | 10/2004 | Jammu et al. | |
| 6,824,110 | B2 | 11/2004 | Kane et al. | |
| 6,845,953 | B2 | 1/2005 | Kane et al. | |
| 6,853,888 | B2 | 2/2005 | Kane et al. | |
| 6,856,865 | B2 | 2/2005 | Hawthorne | |
| 6,863,246 | B2 | 3/2005 | Kane et al. | |
| 6,865,454 | B2 | 3/2005 | Kane et al. | |
| 6,903,658 | B2 | 6/2005 | Kane et al. | |
| 6,915,191 | B2 | 7/2005 | Kane et al. | |
| 6,922,619 | B2 | 7/2005 | Baig et al. | |
| 6,957,131 | B2 | 10/2005 | Kane et al. | |
| 6,978,195 | B2 | 12/2005 | Kane et al. | |
| 6,980,894 | B1 | 12/2005 | Gordon et al. | |
| 6,996,461 | B2 | 2/2006 | Kane et al. | |
| 7,021,588 | B2 | 4/2006 | Hess, Jr. et al. | |
| 7,021,589 | B2 | 4/2006 | Hess, Jr. et al. | |
| 7,024,289 | B2 | 4/2006 | Kane et al. | |
| 7,036,774 | B2 | 5/2006 | Kane et al. | |
| 7,079,926 | B2 | 7/2006 | Kane et al. | |
| 7,092,800 | B2 | 8/2006 | Kane et al. | |
| 7,092,801 | B2 | 8/2006 | Kane et al. | |
| 7,416,262 | B2 | 8/2008 | Ring | |
| 8,157,218 | B2 | 4/2012 | Riley et al. | |
| 8,229,607 | B2 | 7/2012 | Hrdlicka et al. | |
| 8,428,798 | B2 | 4/2013 | Kull | |
| 2001/0029411 | A1 * | 10/2001 | Hawthorne | 701/19 |
| 2001/0035049 | A1 | 11/2001 | Balch | |
| 2002/0059075 | A1 | 5/2002 | Schick et al. | |
| 2002/0096081 | A1 | 7/2002 | Kraft | |
| 2003/0105561 | A1 * | 6/2003 | Nickles et al. | 701/19 |
| 2003/0213875 | A1 | 11/2003 | Hess, Jr. et al. | |
| 2004/0093196 | A1 | 5/2004 | Hawthorne | |
| 2004/0133315 | A1 | 7/2004 | Kumar et al. | |
| 2004/0168998 | A1 * | 9/2004 | Taguchi et al. | 213/7 |
| 2004/0245410 | A1 | 12/2004 | Kisak et al. | |
| 2005/0065674 | A1 | 3/2005 | Houpt et al. | |
| 2005/0120904 | A1 | 6/2005 | Kumar et al. | |
| 2005/0121971 | A1 | 6/2005 | Ring | |
| 2007/0219680 | A1 | 9/2007 | Kumar et al. | |

FOREIGN PATENT DOCUMENTS

| | | | |
|---|---|---|---|
| EP | 1 297 982 | | 4/2003 |
| WO | WO9960735 | A1 | 11/1999 |
| WO | WO2010039680 | A1 | 4/2010 |
| ZA | 200101708 | A | 8/2001 |

* cited by examiner

METHOD AND APPARATUS FOR LIMITING IN-TRAIN FORCES OF A RAILROAD TRAIN

CROSS-REFERENCE TO RELATED APPLICATIONS

This application claims the benefit, under Section 119(e), of the provisional application filed on Dec. 1, 2006, and assigned Application No. 60/868,240.

FIELD OF THE INVENTION

Embodiments of the present invention relate to railroad train operations and more particularly to limiting in-train forces to reduce the likelihood of train and railcar damage.

BACKGROUND OF THE INVENTION

A locomotive is a complex system with numerous subsystems, each subsystem interdependent on other subsystems. An operator aboard a locomotive applies tractive and braking effort to control the speed of the locomotive and its load of railcars to assure proper operation and timely arrival at the desired destination. Speed control must also be exercised to maintain in-train forces within acceptable limits, thereby avoiding excessive coupler forces and the possibility of a train break. To perform this function and comply with prescribed operating speeds that may vary with the train's location on the track, the operator generally must have extensive experience operating the locomotive over the specified terrain with different railcar consists.

Train control can also be exercised by an automatic train control system that determines various train and trip parameters, e.g., the timing and magnitude of tractive and braking applications, to control the train. Alternatively, a train control system advises the operator of preferred train control actions, with the operator exercising train control in accordance with the advised actions or in accordance with his/her independent train control assessments.

The train's coupler slack condition (the distance between two linked couplers and changes in that distance) substantially affects train control. Certain train control actions are permitted if certain slack conditions are present, while other train control actions are undesired since they may lead to train, railcar or coupler damage. If the slack condition of the train (or segments of the train) can be determined, predicted or inferred, proper train control actions can be executed responsive thereto, minimizing damage risks or a train breakup.

BRIEF DESCRIPTION OF THE INVENTION

In an embodiment an apparatus for operating a railway system, the railway system comprising a lead vehicle consist, a non-lead vehicle consist and railcars is disclosed. The apparatus includes a first element for determining a slack condition of railway system segments, wherein the segments are delineated by nodes, and a control element configured to control an application of tractive effort or braking effort of the railway system, lead vehicle consist, and/or the non-lead vehicle consist.

In another embodiment, an apparatus for controlling a railway system, is disclosed. The apparatus a first element for determining a slack condition of the railway system or of segments of the railway system, and a second element for controlling the application of tractive effort or the application of braking effort to the railway system responsive to the slack condition.

In yet another embodiment, an apparatus for determining a slack condition of a railway vehicle of a railway system, the railway vehicle traversing a track segment is disclosed. The apparatus includes a first element for identifying planned applications of tractive effort and braking effort for the railway vehicle while traversing the track segment. A second element is provided for determining the slack condition at one or more locations on the track segment in advance of the railway vehicle traversing the track segment responsive to the planned applications of tractive effort and braking effort. A third element is also provided for redetermining the slack condition at the one or more locations responsive to deviations from the planned applications of tractive effort and braking effort.

In yet another embodiment, an apparatus for determining coupler conditions for a railway system is disclosed. The railway system includes one or more locomotives and railcars, adjacent ones of the one or more locomotives and railcars linked by a closed coupler attached to each of the one or more locomotives and railcars. The apparatus includes a first element for determining a natural acceleration of one or more railcars of the railway system, and a second element for determining a common acceleration of the railway system and determining a relationship between the natural acceleration of a railcar and the common acceleration, wherein the relationship indicates a slack condition for the railcar.

In another embodiment, an apparatus for determining coupler conditions for a railway system, the railway system comprising a lead vehicle consist, a non-lead vehicle consist and railcars, adjacent ones of vehicles and railcars linked by a coupler is disclosed The apparatus has a first element for determining an operating parameter of the lead vehicle consist and an operating parameter of the non-lead vehicle consist, and a second element for determining a slack condition from the operating parameter of the lead vehicle consist and the operating parameter of the non-lead vehicle consist.

An apparatus for determining coupler slack conditions for a railway system, the railway system comprising a lead vehicle consist, a non-lead vehicle consist and railcars, adjacent ones of vehicles and railcars linked by a coupler is disclosed in another embodiment. The apparatus includes a first element for determining a force exerted on a coupler, wherein the force is greater than an expected force, and a second element for determining a slack condition or a change in a slack condition responsive to the force.

An apparatus for controlling in-train forces of a railway system is disclosed in another embodiment. The apparatus has a first element for determining a slack condition of the entire system or of segments of the system, and a second element for controlling application of tractive effort and braking effort to control the slack condition to limit the in-system forces to an acceptable level. The first element determines the distance between two spaced-apart locations on the railway system and determines the slack condition between the two spaced-apart locations from the distance.

An apparatus for controlling a railway system is also disclosed as having a first element for determining a current state of the railway system, a second element for determining an expected state of the railway system, and a third element for determining a difference between the current state and the expected state.

An apparatus for controlling a railway system is further disclosed as having a first element for determining a slack condition of the railway system and a range of uncertainty of the determined slack condition, and a second element for controlling the application of tractive effort or the application of braking effort to the railway system responsive to the slack condition and the range of uncertainty.

In yet another embodiment an apparatus for controlling a railroad train that has one or more locomotive consists each having one or more trailing railcars with the railroad train having an operator in one of the locomotive consists is disclosed. A first element for supplying train characteristics is provided and so is a second element for supplying train movement parameters. A third element for determining a slack condition from at least one of the train characteristics and the train movement parameters, and a fourth element for applying tractive effort or braking effort responsive to the slack condition are also provided. The operator has the ability to override the slack condition determined by the third element and to override the application of tractive effort or the application of braking effort applied by the fourth element. A display for providing slack condition information is also provided.

In another embodiment an method for operating a railway system is disclosed where the railway system has a lead vehicle consist, a non-lead vehicle consist and railcars. The method includes a step for determining a slack condition of railway system segments, wherein the segments are delineated by nodes; and a step for controlling an application of tractive effort or braking effort of at least one of the railway system, the lead vehicle consist, and the non-lead vehicle consist.

A method for determining a slack condition of a railway system is also provided A step for determining railway system operating parameters, and a step for determining an equivalent grade from the operating parameters are included. Other steps include determining an actual track grade over which the railway system is traversing, and determining a slack condition from the equivalent grade and the actual track grade.

A method for controlling a railway system is disclosed. The method includes a step for determining previous tractive effort and braking effort applications over a track segment. A step for determining a slack condition of the track segment responsive to the previous tractive effort or braking effort applications is also disclosed. Another step includes controlling a railway system later traversing the track segment according to determined previous tractive effort and braking effort applications over the track segment.

A method for determining in-system forces of a railway system, wherein the railway system has one or more motive power vehicles and a plurality of railcars is further disclosed. The method includes steps for determining a distance between two vehicles, between a vehicle and a railcar or between two railcars at a first time and at a second time, and determining a slack condition of the entire railway system or of railway system segments responsive to determined distances between two vehicles, between a vehicle and a railcar or between two railcars.

A method for determining in-system forces of a railway system, wherein the railway system has one or more vehicles and railcars, an adjacent vehicle and railcar and adjacent railcars linked by a coupler is further disclosed. The method includes steps for determining a sign of forces exerted on a coupler, and determining a slack condition of the coupler from the sign of the forces.

A method for determining coupler conditions for a railway system is also disclosed. The railway system has one or more vehicles and railcars, adjacent one or more motive power vehicles and railcars linked by a coupler. The method includes a step for determining a natural acceleration of one or more railcars of the train, and a step for determining a common acceleration of the train. A step for determining a relationship between the natural acceleration of a railcar and the common acceleration, wherein the relationship indicates a slack condition for the railcar is also provided.

In yet another embodiment, a method for determining coupler conditions for a railway system, the railway system having one or more motive-power vehicles and railcars, adjacent one or more vehicles and railcars linked by a coupler is disclosed. The method has a step for determining a rate of change of an acceleration or of a velocity experienced by one of the vehicles or one of the railcars. Another step is provided for determining whether the rate of change is responsive to the application of tractive effort or braking effort applied by one of the vehicles. A third step is provided for determining the coupler conditions if the rate of change is not responsive to the application of tractive effort or braking effort applied by one of the vehicles.

A computer program product for determining a slack condition of a railway system is disclosed. The computer program produce includes a computer usable medium having computer readable program code modules embodied in the medium for determining the slack condition. A first computer readable program code module for determining railway system operating parameters and a second computer readable program code module for determining an equivalent grade from the operating parameters are also provided. A third computer readable program code module is also provided for determining an actual track grade over which the railway system is traversing, and a fourth computer readable program code module for determining a slack condition from the equivalent grade and the actual track grade is further disclosed.

In another embodiment a computer program produce for determining in-system forces of a railway system is disclosed. A computer usable medium having computer readable program code modules embodied in the medium for determining the in-system forces is provide. A first computer readable program code module for determining previous tractive effort and braking effort applications and a second computer readable program code module for determining a slack condition of the entire railway system or of railway system segments responsive to the previous tractive effort or braking effort applications are also included.

In yet another embodiment a computer program product for determining in-system forces of a railway system, wherein the railway system has one or more motive power vehicles and a plurality of railcars is disclosed. The computer program product includes a computer usable medium having computer readable program code modules embodied in the medium for determining the in-system forces. A first computer readable program code module for determining a distance between two vehicles, between a vehicle and a railcar or between two railcars at a first time and at a second time, and a second computer readable program code module for determining a slack condition of the entire railway system or of railway system segments responsive to determined distances between the two vehicles, between the vehicle and the railcar or between the two railcars are also disclosed.

A computer program product is further disclosed for determining a slack condition of a railway system, wherein the railway system has one or more vehicles and railcars, an adjacent vehicle and railcar and adjacent railcars linked by a coupler. The computer program product includes a computer usable medium having computer readable program code modules embodied in the medium for determining the slack condition. A first computer readable program code module for determining a sign of forces exerted on a coupler; and a second computer readable program code module for determining a slack condition of the coupler from the sign of the forces are also disclosed.

A computer program product for determining coupler conditions for a railway system, where the railway system has one or more vehicles and railcars, adjacent one or more motive power vehicles and railcars linked by a coupler. The computer program product includes a computer usable medium having computer readable program code modules embodied in the medium for determining the slack condition. A first computer readable program code module for determining a natural acceleration of one or more railcars of the train, a second computer readable program code module for determining a common acceleration of the train, and a third computer readable program code module for determining a relationship between the natural acceleration of a railcar and the common acceleration, wherein the relationship indicates a slack condition for the railcar are also disclosed.

A computer program product for determining coupler conditions for a railway system, where the railway system has one or more motive-power vehicles and railcars, adjacent one or more vehicles and railcars linked by a coupler is further disclosed. The computer program product includes a computer usable medium having computer readable program code modules embodied in the medium for determining the coupler conditions. A first computer readable program code module for determining a rate of change of an acceleration or of a velocity experienced by one of the vehicles or one of the railcars is also disclosed. Further disclosed is a second computer readable program code module for determining whether the rate of change is responsive to the application of tractive effort or braking effort applied by one of the vehicles. A third computer readable program code module is also provided for determining the coupler conditions if the rate of change is not responsive to the application of tractive effort or braking effort applied by one of the vehicles.

In yet another embodiment, a computer program product for controlling a railway system is disclosed. The product has a computer usable medium having computer readable program code modules embodied in the medium for determining previous tractive effort and braking effort applications over a track segment. A computer usable medium having computer readable program code modules embodied in the medium is further provided for determining a slack condition of the track segment responsive to the previous tractive effort or braking effort applications. Additionally, a computer usable medium having computer readable program code modules embodied in the medium is disclosed for controlling a railway system later traversing the track segment according to determined previous tractive effort or braking effort applications over the track segment.

A computer program product for determining coupler conditions for a railway system is further disclosed. The railway system has one or more motive-power vehicles and railcars, adjacent one or more vehicles and railcars linked by a coupler. The product has computer usable medium having computer readable program code modules embodied in the medium for determining a rate of change of an acceleration or of a velocity experienced by one of the vehicles or one of the railcars. Computer usable medium having computer readable program code modules embodied in the medium is also provided for determining whether the rate of change is responsive to the application of tractive effort or braking effort applied by one of the vehicles. Furthermore computer usable medium having computer readable program code modules embodied in the medium is disclosed for determining the coupler conditions if the rate of change is not responsive to the application of tractive effort or braking effort applied by one of the vehicles.

A computer program product for operating a railway system, where the railway system has a lead vehicle consist, a non-lead vehicle consist and railcars, is disclosed. The computer program product includes a computer usable medium having computer readable program code modules embodied in the medium for determining a slack condition of railway system segments, wherein the segments are delineated by nodes. Also computer usable medium having computer readable program code modules embodied in the medium for controlling an application of tractive effort or braking effort of at least one of the railway system, the lead vehicle consist, and the non-lead vehicle consist is also provided.

BRIEF DESCRIPTION OF THE DRAWINGS

A more particular description of the embodiments of the invention will be rendered by reference to specific embodiments thereof that are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE INVENTION

Figure 1:
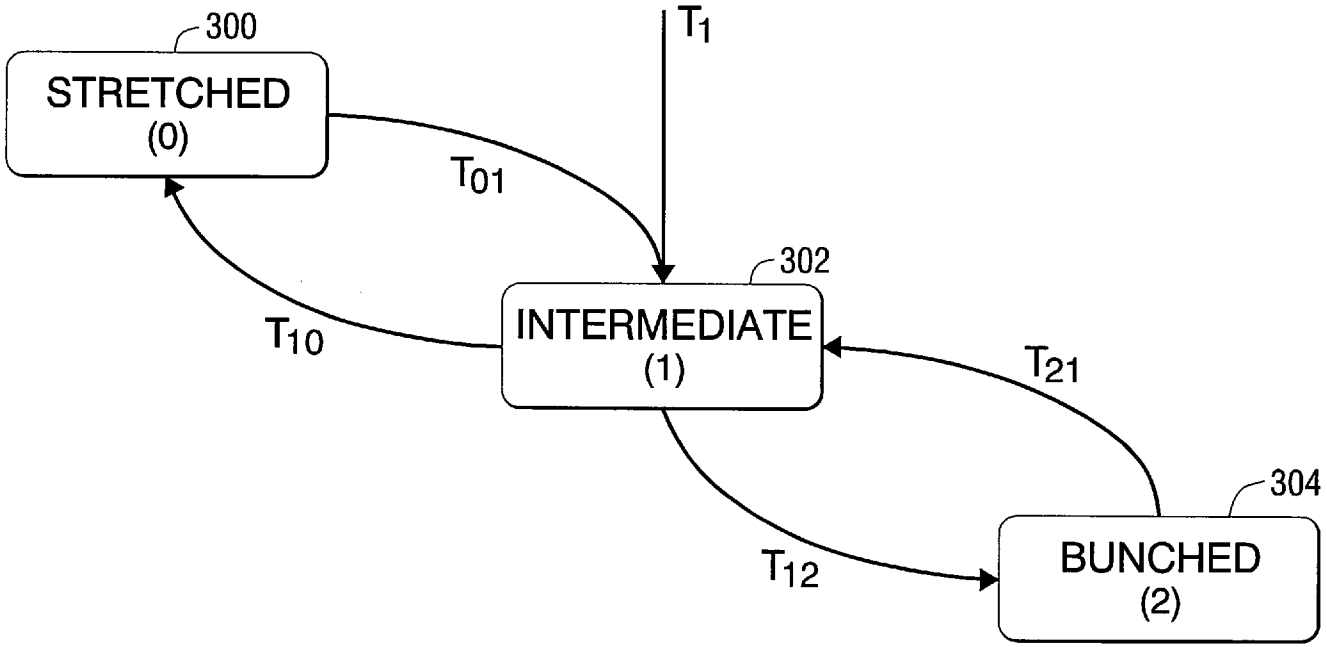
FIGS. 1 and 2 graphically depict slack conditions of a railroad train.

Reference will now be made in detail to the embodiments consistent with aspects of the invention, examples of which are illustrated in the accompanying drawings. Wherever possible, the same reference numerals used throughout the drawings refer to the same or like parts.

Embodiments of the present invention solve certain problems in the art by providing a system, method, and computer implemented method for limiting in-train forces for a railway system, including in various applications, a locomotive consist, a maintenance-of-way vehicle and a plurality of railcars. The present embodiments are also applicable to a train including a plurality of distributed locomotive consists, referred to as a distributed power train, typically including a lead consist and one or more non-lead consists.

Persons skilled in the art will recognize that an apparatus, such as a data processing system, including a CPU, memory, I/O, program storage, a connecting bus, and other appropriate components, could be programmed or otherwise designed to facilitate the practice of the method of the invention embodiments. Such a system would include appropriate program means for executing the methods of these embodiments.

In another embodiment, an article of manufacture, such as a pre-recorded disk or other similar computer program product, for use with a data processing system, includes a storage medium and a program recorded thereon for directing the data processing system to facilitate the practice of the method of the embodiments of the invention. Such apparatus and articles of manufacture also fall within the spirit and scope of the embodiments.

The disclosed invention embodiments teach methods, apparatuses, and programs for determining a slack condition and/or quantitative/qualitative in-train forces and for controlling the railway system responsive thereto to limit such in-train forces. To facilitate an understanding of the embodiments of the present invention they are described hereinafter with reference to specific implementations thereof.

According to one embodiment, the invention is described in the general context of computer-executable instructions, such as program modules, executed by a computer. Generally, program modules include routines, programs, objects, components, data structures, etc. that perform particular tasks or implement particular abstract data types. For example, the software programs that underlie the embodiments of the invention can be coded in different languages, for use with different processing platforms. It will be appreciated, however, that the principles that underlie the embodiments can be implemented with other types of computer software technologies as well.

Moreover, those skilled in the art will appreciate that the embodiments of the invention may be practiced with other computer system configurations, including hand-held devices, multiprocessor systems, microprocessor-based or programmable consumer electronics, minicomputers, mainframe computers, and the like. The embodiments of the invention may also be practiced in a distributed computing environment where tasks are performed by remote processing devices that are linked through a communications network. In the distributed computing environment, program modules may be located in both local and remote computer storage media including memory storage devices. These local and remote computing environments may be contained entirely within the locomotive, within other locomotives of the train, within associated railcars, or off-board in wayside or central offices where wireless communications are provided between the different computing environments.

The term "locomotive" can include (1) one locomotive or (2) multiple locomotives in succession (referred to as a locomotive consist), connected together so as to provide motoring and/or braking capability with no railcars between the locomotives. A train may comprise one or more such locomotive consists. Specifically, there may be a lead consist and one or more remote (or non-lead) consists, such as a first non-lead (remote) consist midway along the line of railcars and another remote consist at an end-of-train position. Each locomotive consist may have a first or lead locomotive and one or more trailing locomotives. Though a consist is usually considered connected successive locomotives, those skilled in the art recognize that a group of locomotives may also be consider a consist even with at least one railcar separating the locomotives, such as when the consist is configured for distributed power operation, wherein throttle and braking commands are relayed from the lead locomotive to the remote trails over a radio link or a physical cable. Towards this end, the term locomotive consist should be not be considered a limiting factor when discussing multiple locomotives within the same train.

Referring now to the drawings, embodiments of the present invention will be described. The various embodiments of the invention can be implemented in numerous ways, including as a system (including a computer processing system), a method (including a computerized method), an apparatus, a computer readable medium, a computer program product, a graphical user interface, including a web portal, or a data structure tangibly fixed in a computer readable memory. Several embodiments of the various invention embodiments are discussed below.

Two adjacent railroad railcars or locomotives are linked by a knuckle coupler attached to each railcar or locomotive. Generally, the knuckle coupler includes four elements, a cast steel coupler head, a hinged jaw or "knuckle" rotatable relative to the head, a hinge pin about which the knuckle rotates during the coupling or uncoupling process and a locking pin. When the locking pin on either or both couplers is moved upwardly away from the coupler head the locked knuckle rotates into an open or released position, effectively uncoupling the two railcars/locomotives. Application of a separating force to either or both of the railcars/locomotives completes the uncoupling process.

When coupling two railcars, at least one of the knuckles must be in an open position to receive the jaw or knuckle of the other railcar. The two railcars are moved toward each other. When the couplers mate the jaw of the open coupler closes and responsive thereto the gravity-fed locking pin automatically drops in place to lock the jaw in the closed condition and thereby lock the couplers closed to link the two railcars.

Even when coupled and locked, the distance between the two linked railcars can increase or decrease due to the spring-like effect of the interaction of the two couplers and due to the open space between the mated jaws or knuckles. The distance by which the couplers can move apart when coupled is referred to as an elongation distance or coupler slack and can be as much as about four to six inches per coupler. A stretched slack condition occurs when the distance between two coupled railcars is about the maximum separation distance permitted by the slack of the two linked couplers. A bunched (compressed) condition occurs when the distance between two adjacent railcars is about the minimum separation distance as permitted by the slack between the two linked couplers.

As is known, a train operator (e.g., either a human train engineer with responsibility for operating the train, an automatic train control system that operates the train without or with minimal operator intervention or an advisory train control system that advises the operator to implement train control operations while allowing the operator to exercise independent judgment as to whether the train should be controlled as advised) increases the train's commanded horsepower/speed by moving a throttle handle to a higher notch position and decreases the horsepower/speed by moving the throttle handle to a lower notch position or by applying the train brakes (the locomotive dynamic brakes, the independent air brakes or the train air brakes). Any of these operator actions, as well as train dynamic forces and the track profile, can affect the train's overall slack condition and the slack condition between any two linked couplers.

When referred to herein tractive effort further includes braking effort and braking effort further includes braking actions resulting from the application of the locomotive dynamic brakes, the locomotive independent brakes and the air brakes throughout the train.

The in-train forces that are managed by the application of tractive effort (TE) or braking effort (BE) are referred to as draft forces (a pulling force or a tension) on the couplers and draft gear during a stretched slack state and referred to as buff forces during a bunched or compressed slack condition. A draft gear includes a force-absorbing element that transmits draft or buff forces between the coupler and the railcar to which the coupler is attached.

A FIG. 1 state diagram depicts three discrete slack states: a stretched state 300, an intermediate state 302 and a bunched state 304. Transitions between states, as described herein, are indicated by arrowheads referred to as transitions "T" with a subscript indicating a previous state and a new state.

State transitions are caused by the application of tractive effort (that tends to stretch the train), braking effort (that tends to bunch the train) or changes in terrain that can cause either a run-in or a run-out. The rate of train stretching (run-out) depends on the rate at which the tractive effort is applied as measured in horsepower/second or notch position change/second. For example, tractive effort is applied to move from the intermediate state (1) to the stretched state (0) along a transition $T_{10}$. For a distributed power train including remote locomotives spaced-apart from the lead locomotive in the train consist, the application of tractive effort at any locomotive tends to stretch the railcars following that locomotive (with reference to the direction of travel).

Generally, when the train is first powered up the initial coupler slack state is unknown. But as the train moves responsive to the application of tractive effort the state is determinable. The transition $T_1$ into the intermediate state (1) depicts the power-up scenario.

The rate of train bunching (run-in) depends on the braking effort applied as determined by the application of the dynamic brakes, the locomotive independent brakes or the train air brakes.

The intermediate state 302 is not a desired state. The stretched state 300 is preferred, as train handling is easiest when the train is stretched, although the operator can accommodate a bunched state.

The FIG. 1 state machine can represent an entire train or train segments (e.g., the first 30% of the train in a distributed power train or a segment of the train bounded by two spaced-apart locomotive consists). Multiple independent state machines can each describe a different train segment, each state machine including multiple slack states such as indicated in FIG. 1. For example a distributed power train or pusher operation can be depicted by multiple state machines representing the multiple train segments, each segment defined, for example, by one of the locomotive consists within the train.

Figure 2:
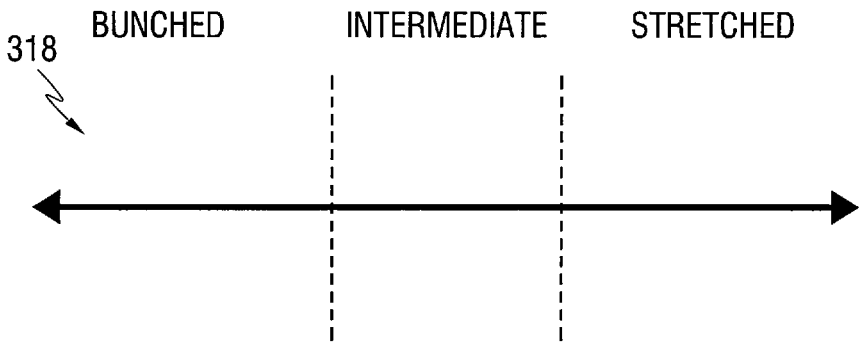

As an alternative to the discrete states representation of FIG. 1, FIG. 2 depicts a curve 318 representing a continuum of slack states from a stretched state through an intermediate state to a bunched state, each state generally indicated as shown. The FIG. 2 curve more accurately portrays the slack condition than the state diagram of FIG. 1, since there are no universal definitions for discrete stretched, intermediate and bunched states, as FIG. 1 might suggest. As used herein, the term slack condition refers to discrete slack states as illustrated in FIG. 1 or a continuum of slack states as illustrated in FIG. 2.

Like FIG. 1, the slack state representation of FIG. 2 can represent the slack state of the entire train or train segments. In one example the segments are bounded by locomotive consists and the end-of-train device. One train segment of particular interest includes the railcars immediately behind the lead consist where the total forces, including steady state and slack-induced transient forces, tend to be highest. Similarly, for a distributed power train, the particular segments of interest are those railcars immediately behind and immediately ahead of the non-lead locomotive consists.

To avoid coupler and train damage, the train's slack condition can be taken into consideration when applying TE or BE. The slack condition refers to one or more of a current slack condition, a change in slack condition from a prior time or track location to a current time or current track location and a current or real time slack transition (e.g., the train is currently experiencing a run-in or a run-out slack transition. The rate of change of a real time slack transition can also affect the application of TE and BE to ensure proper train operation and minimize damage potential.

The referred to TE and BE can be applied to the train by control elements/control functions, including, but not limited to, the operator by manual manipulation of control devices, automatically by an automatic control system or manually by the operator responsive to advisory control recommendations produced by an advisory control system. Typically, an automatic train control system implements train control actions (and an advisory control system suggests train control actions for consideration by the operator) to optimize a train performance parameter, such as fuel consumption.

In another embodiment, the operator can override a desired control strategy responsive to a determined slack condition or slack event and control the train or cause the automatic control system control the train according to the override information. For example, the operator can control (or have the train control system control) the train in situations where the train manifest information supplied to the system for determining the slack condition is incorrect or when another discrepancy determines an incorrect slack condition. The operator can also override automatic control, including overriding during a run-in or a run-out condition.

Figure 3:
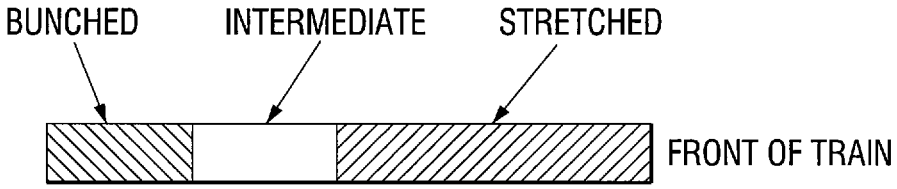
FIGS. 3 and 4 depict slack condition displays according to different embodiments of the invention.

The determined slack condition or a current slack transition can be displayed to the operator during either manual operation or when an automatic train control system is present and active. Many different display forms and formats can be utilized depending on the nature of the slack condition determined. For example if only three discrete slack states are determined, a simple text box can be displayed to notify the operator of the determined state. If multiple slack states are identified, the display can be modified accordingly. For a system that determines a continuous slack state the display can present a percent or number or total weight of cars stretched and bunched. Similarly, many different graphical depictions may be used to display or represent the slack condition information, such as animated bars with various color indications based on slack condition (i.e., those couplers greater than 80% stretched indicated with a green bar). A representation of the entire train can be presented and the slack condition (see FIG. 3) or changing slack condition (slack event)(see FIG. 4) depicted thereon.

Train characteristic parameters (e.g., railcar masses, mass distribution) for use by the apparatuses and methods described herein to determine the slack condition can be supplied by the train manifest or by other techniques known in the art. The operator can also supply train characteristic information, overriding or supplementing previously provided information, to determine the slack condition according to the embodiments of the invention. The operator can also input a slack condition for use by the control elements in applying TE and BE.

When a train is completely stretched, additional tractive effort can be applied at a relatively high rate in a direction to increase the train speed (i.e., a large acceleration) without damaging the couplers, since there will be little relative movement between linked couplers. Any such induced additional transient coupler forces are small beyond the expected steady-state forces that are due to increased tractive effort and track grade changes. But when in a stretched condition, a substantial reduction in tractive effort at the head end of the train, the application of excessive braking forces or the application of braking forces at an excessive rate can suddenly reduce the slack between linked couplers. The resulting forces exerted on the linked couplers can damage the couplers, causing the railcars to collide or derail the train.

As a substantially compressed train is stretched (referred to as run-out) by the application of tractive effort, the couplers linking two adjacent railcars move apart as the two railcars (or locomotives) move apart. As the train is stretching, relatively large transient forces are generated between the linked couplers as they transition from a bunched to a stretched state. In-train forces capable of damaging the coupling system or breaking the linked couplers can be produced even at relatively slow train speeds of one or two miles per hour. Thus if the train is not completely stretched it is necessary to limit the forces generated by the application of tractive effort during slack run-out.

When the train is completely bunched, additional braking effort (by operation of the locomotive dynamic brakes or independent brakes) or a reduction of the propulsion forces can be applied at a relatively high rate without damage to the couplers, draft gears or railcars. But the application of excessive tractive forces or the application of such forces at an excessive rate can generate high transient coupler forces that cause adjacent railcars to move apart quickly, changing the coupler's slack condition, leading to possible damage of the coupler, coupler system, draft gear or railcars.

As a substantially stretched train is compressed (referred to as run-in) by applying braking effort or reducing the train speed significantly by moving the throttle to a lower notch position, the couplers linking two adjacent cars move together. An excessive rate of coupler closure can damage the couplers, damage the railcars or derail the train. Thus if the train is not completely bunched it is necessary to limit the forces generated by the application of braking effort during the slack run-in period.

If the operator (a human operator or automatic control system) knows the current slack condition (for example, in the case of a human operator, by observing a slack condition display as described above) then the train can be controlled by commanding an appropriate level of tractive or braking effort to maintain or change the slack condition as desired. Braking the train tends to create slack run-in and accelerating the train tends to create slack run-out. For example, if a transition to the bunched condition is desired, the operator may switch to a lower notch position or apply braking effort at the head end to slow the train at a rate less than its natural acceleration. The natural acceleration is the acceleration of a railcar when no external forces (except gravity) are acting on it. The i th railcar is in a natural acceleration state when neither the i+1 nor the i−1 railcar is exerting any forces on it. The concept is described further below with reference to FIG. 9 and the associated text.

If slack run-in or run-out occurs without operator action, such as when the train is descending a hill, the operator can counter those effects, if desired, by appropriate application of higher tractive effort to counter a run-in or braking effort or lower tractive effort to counter a run-out.

Figure 5:
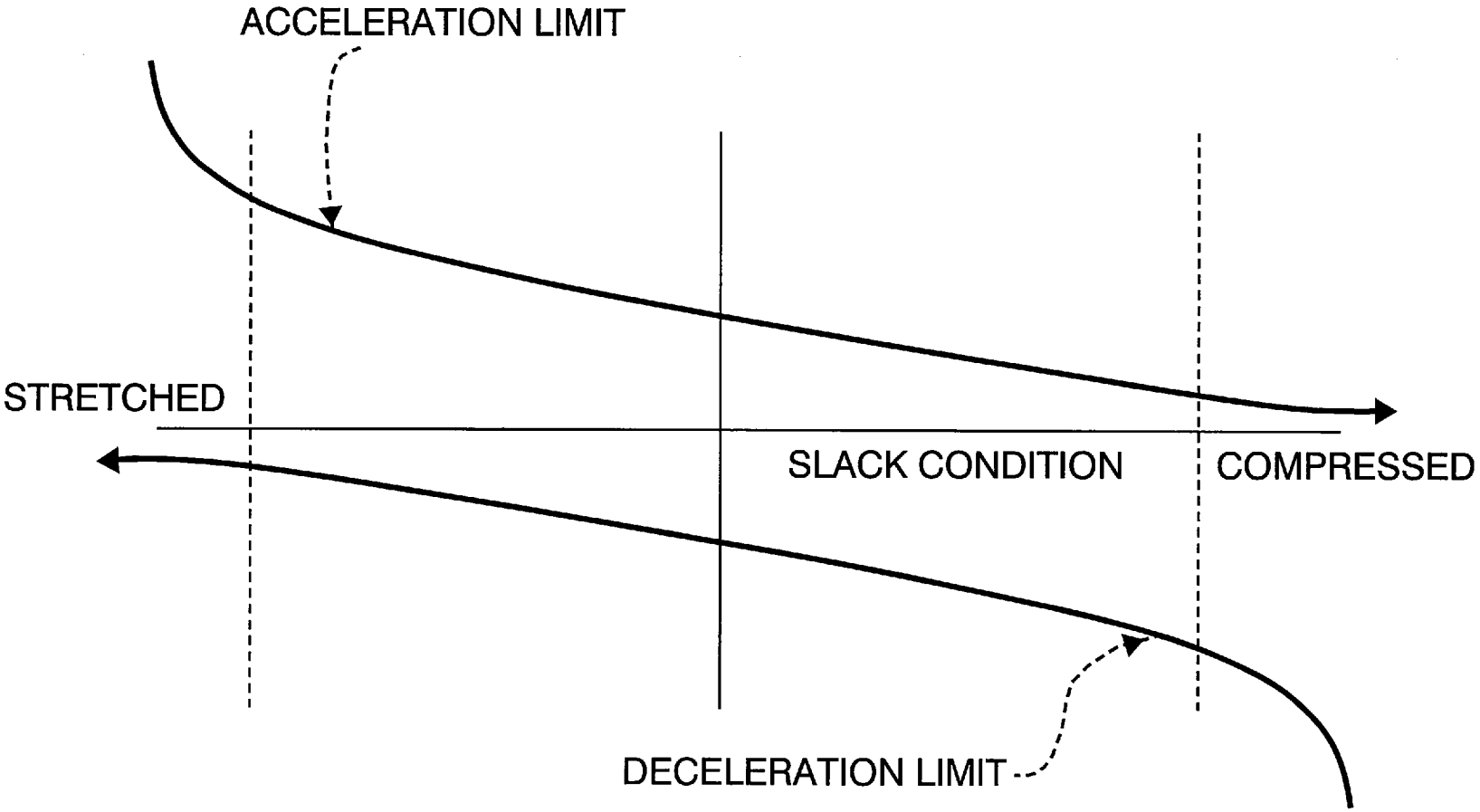
FIG. 5 graphically depicts acceleration and deceleration limits based on the slack condition.

FIG. 5 graphically illustrates limits on the application of tractive effort (accelerating the train) and braking effort (decelerating the train) as a function of a slack state along the continuum of slack conditions between stretched and compressed. As the slack condition tends toward a compressed state, the range of acceptable acceleration forces decreases to avoid imposing excessive forces on the couplers, but acceptable decelerating forces increase. The opposite situation exists as the slack condition tends toward a stretched condition.

Figure 6:
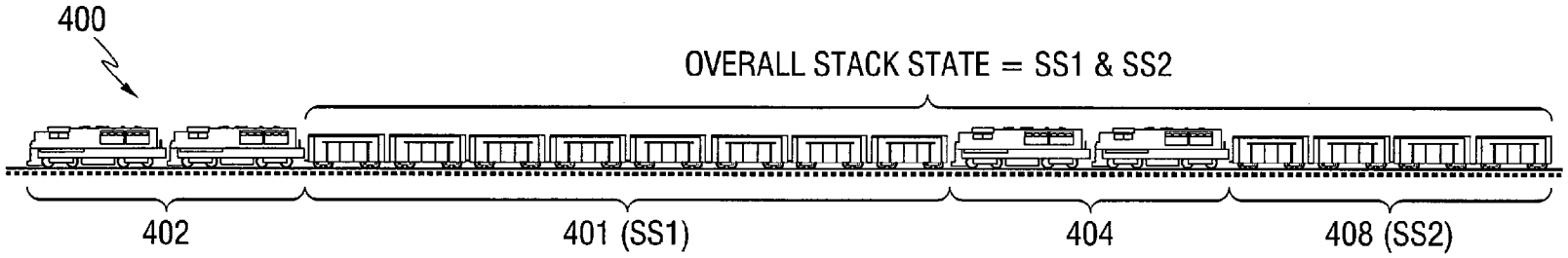
FIG. 6 illustrates multiple slack conditions associated with a railroad train.

FIG. 6 illustrates train segment slack states for a train 400. Railcars 401 immediately behind a locomotive consist 402 are in a first slack state (SS1) and railcars 408 immediately behind a locomotive consist 404 are in a second slack state (SS2). An overall slack state (SS1 and SS2) encompassing the slack states SS1 and SS2 and the slack state of the locomotive consist 404, is also illustrated.

Designation of a discrete slack state as in FIG. 1 or a slack condition on the curve 318 of FIG. 2 includes a degree of uncertainty dependent on the methods employed to determine the slack state/condition and practical limitations associated with these methods.

One embodiment of the present invention determines, infers or predicts the slack condition for the entire train, i.e., substantially stretched, substantially bunched or in an intermediate slack state, including any number of intermediate discrete states or continuous states. The embodiments of the invention can also determine the slack condition for any segment of the train. The embodiments of the invention also detect (and provide the operator with pertinent information related thereto) a slack run-in (rapid slack condition change from stretched to bunched) and a slack run-out (rapid slack condition change from bunched to stretched), including run-in and run-out situations that may result in train damage. These methodologies are described below.

Responsive to the determined slack condition, the train operator controls train handling to contain in-train forces that can damage the couplers and cause a train break when a coupler fails, while also maximizing train performance. To improve train operating efficiency, the operator can apply a higher deceleration rate when the train is bunched and conversely apply a higher acceleration rate when the train is stretched. However, irrespective of the slack condition, the operator must enforce maximum predetermined acceleration and deceleration limits (i.e., the application of tractive effort and the corresponding speed increases and the application of braking effort and the corresponding speed decreases) for proper train handling.

Different embodiments of the present invention comprise different processes and use different parameters and information for determining, inferring or predicting the slack state/condition, including both a transient slack condition and a steady-state slack condition. Those skilled in the art will recognize that transient slack condition could also mean the rate of change at which slack transition point is moving through the train. The input parameters from which the slack condition can be determined, inferred or predicted include, but are not limited to, distributed train weight, track profile, track grade, environmental conditions (e.g., rail friction, wind), applied tractive effort, applied braking effort, brake pipe pressure, historical tractive effort, historical braking effort, train speed/acceleration measured at any point along the train and railcar characteristics. The time rate at which the slack condition is changing (a transient slack condition) or the rate at which the slack condition is moving through the train may also be related to one or more of these parameters.

The slack condition can also be determined, inferred or predicted from various train operational events, such as, the application of sand to the rails, isolation of locomotives and flange lube locations. Since the slack condition is not necessarily the same for all train railcars at each instant in time, the slack can be determined, inferred or predicted for individual railcars or for segments of railcars in the train.

Figure 7:
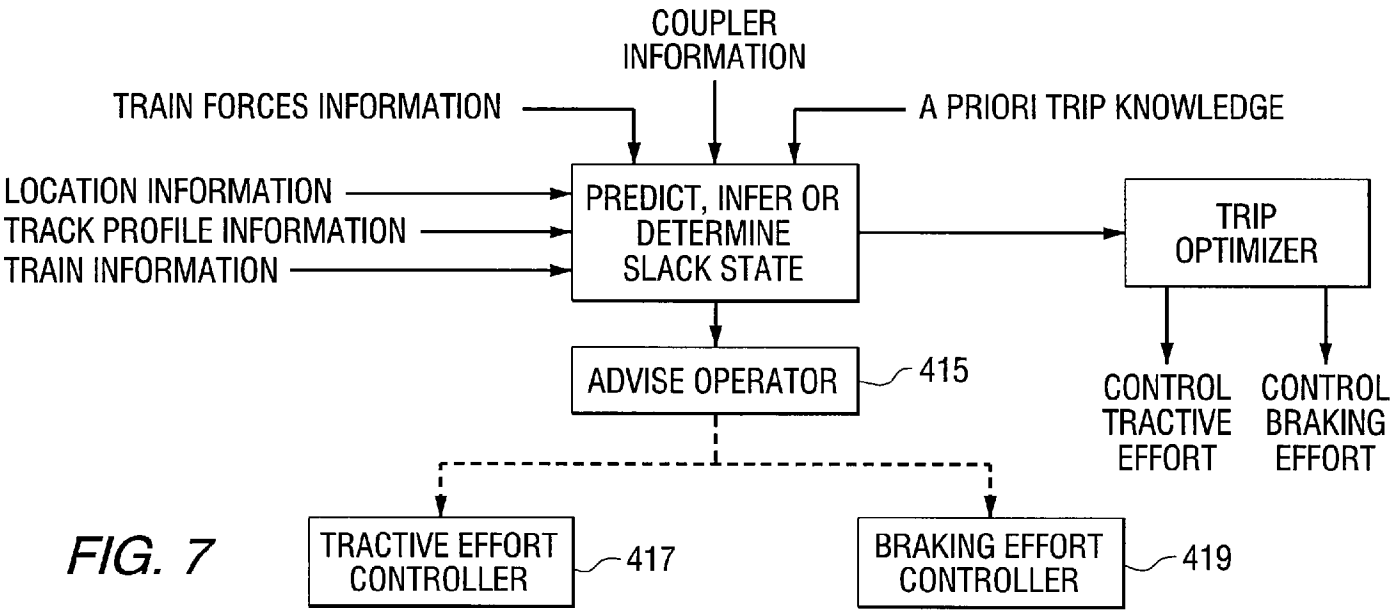
FIG. 7 illustrates a block diagram of a system for determining a slack condition and controlling a train responsive thereto.

FIG. 7 generally indicates the information and various parameters that can be used according to the embodiments of the present invention to determine, infer or predict the slack condition, as further described below.

A priori trip information includes a trip plan (preferably an optimized trip plan) including a speed and/or power (traction effort (TE)/braking effort (BE)) trajectory for a segment of the train's trip over a known track segment. Assuming that the train follows the trip plan, the slack condition can be predicted or inferred at any point along the track to be traversed, either before the trip has begun or while en route, based on the planned upcoming brake and tractive effort applications and the physical characteristics of the train (e.g., mass, mass distribution, resistance forces) and the track.

In one embodiment the system of one embodiment of the present invention can further display to the operator any situation where poor train handling is expected to occur such as when rapid slack state transitions are predicted. This display can take numerous forms including distance/time to a next significant slack transition, an annotation on a rolling map and other forms.

In an exemplary application of one embodiment of the invention to a train control system that plans a train trip and controls train movement to optimize train performance (based, for example, on determined, predicted or inferred train characteristics and the track profile), the a priori information can be sufficient for determining the slack condition of the train for the entire train trip. Any human operator initiated changes from the optimized trip plan may change the slack condition of the train at any given point along the trip.

During a trip that is planned a priori, real time operating parameters may be different than assumed in planning the trip. For example, the wind resistance encountered by the train may be greater than expected or the track friction may be less than assumed. When the trip plan suggests a desired speed trajectory, but the speed varies from the planned trajectory due to these unexpected operating parameters, the operator (including both the human operator manually controlling the train and the automatic train control system) may modify the applied TE/BE to return the train speed to the planned train speed. If the actual train speed tracks the planned speed trajectory then the real time slack condition will remain unchanged from predicted slack condition based on the a priori trip plan.

In an application where the automatic train control system commands application of TE/BE to execute the trip plan, a closed-loop regulator operating in conjunction with the control system receives data indicative of operating parameters, compares the real time parameter with the parameter value assumed in formulating the trip and responsive to differences between the assumed parameter and the real time parameter, modifies the TE/BE applications to generate a new trip plan. The slack condition is redetermined based on the new trip plan and operating conditions.

Coupler information, including coupler types and the railcar type on which they are mounted, the maximum sustainable coupler forces and the coupler dead band, may also be used to determine, predict or infer the slack condition. In particular, this information may be used in determining thresholds for transferring from a first slack state to a second slack state, for determining, predicting or inferring the confidence level associated with a slack state, for selecting the rate of change of TE/BE applications and/or for determining acceptable acceleration limits. This information can be obtained from the train make-up or one can initially assume a coupler state and learn the coupler characteristics during the trip as described below.

In another embodiment, the information from which the coupler state is determined, can be supplied by the operator via a human machine interface (HMI). The HMI-supplied information can be configured to override any assumed parameters. For example, the operator may know that a particular train/trip/track requires smoother handling than normal due to load and/or coupler requirements and may therefore select a "sensitivity factor" for use in controlling the train. The sensitivity factor is used to modify the threshold limits and the allowable rate of change of TE/BE. Alternately the operator can specify coupler strength values or other coupler characteristics from which the TE/BE can be determined.

The slack condition at a future time or at a forward track position can be predicted during the trip based on the current state of the train (e.g., slack condition, location, power, speed and acceleration), train characteristics, the a priori speed trajectory to the forward track location (as will be commanded by the automatic train control system or as determined by the train operator) and the train characteristics. The coupler slack condition at points along the known track segment is predicted assuming tractive and braking efforts are applied according to the trip plan and/or the speed is maintained according to the trip plan. Based on the proposed trip plan, the slack condition determination, prediction or inference and the allowed TE/BE application changes, the plan can be modified before the trip begins (or forecasted during the trip) to produce acceptable forces based on the a priori determination.

Train control information, such as the current and historical throttle and brake applications affect the slack condition and can be used to determine, predict or infer the current slack stare in conjunction with the track profile and the train characteristics. Historical data may also be used to limit the planned force changes at certain locations during the trip.

The distance between locomotive consists in a train can be determined directly from geographical position information for each consist (such as from a GPS location system onboard at least one locomotive per consist or a track-based location system). If the compressed and stretched train lengths are known, the distance between locomotive consists directly indicates the overall (average) slack condition between the consists. For a train with multiple locomotive consists, the overall slack condition for each segment between successive locomotive consists can be determined in this way. If the coupler characteristics (e.g., coupler spring constant and slack) are not known a priori, the overall characteristics can be deduced based on the steady state tractive effort and the distance between consists as a function of time.

The distance between any locomotive consist and the end-of-train device can also be determined, predicted or inferred from location information (such as from a GPS location system or a track-based location system). If the compressed and stretched train lengths are known, the distance between the locomotive consist and the end-of-train device directly indicates the slack condition. For a train with multiple locomotive consists, multiple slack states can be determined, predicted or inferred between the end-of-train device and each of the locomotive consists based on the location information. If the coupler characteristics are not known a priori, the overall characteristics can be deduced from the steady state tractive effort and the distance between the lead consist and the end of train device.

Prior and present location information for railcars and locomotives can be used to determine whether the distance between two points in the train has increased or decreased during an interval of interest and thereby indicate whether the slack condition has tended to a stretched or compressed state during the interval. The location information can be determined for the lead or trailing locomotives in a remote or non-lead consist, for remote locomotives in a distributed power train and for the end-of-train device. A change in slack condition can be determined for any of the train segments bounded by these consists or the end-of-train device.

The current slack condition can also be determined, predicted or inferred in real time based on the current track profile, current location (including all the railcars), current speed/acceleration and tractive effort. For example, if the train has been accelerating at a high rate relative to it's natural acceleration, then the train is stretched.

If the current slack condition is known and it is desired to attain a specific slack condition at a later time in the trip, the operator can control the tractive and braking effort to attain the desired slack condition.

A current slack action event, i.e., the train is currently experiencing a change in slack condition, such as a transition between compression and stretching (run-in/run-out), can also be detected as it occurs according to the various embodiments of the present invention. In one embodiment, the slack event can be determined regardless of the track profile, current location and past slack condition. For example, if there is a sudden change in the locomotive/consist speed without corresponding changes in the application of tractive or braking efforts, then it can be assumed that an outside force acted on the locomotive or the locomotive consist causing the slack event.

According to other embodiments, information from other locomotives (including trailing locomotives in a lead locomotive consist and remote locomotives in a distributed power train) provide position/distance information (as described above), speed and acceleration information (as described below) to determine, predict or infer the slack condition. Also, various sensors and devices on the train (such as the end-of-train device) and proximate the track (such as wayside sensors) can be used to provide information from which the slack condition can be determined, predicted or inferred.

Current and future train forces, either measured or predicted from train operation according to a predetermined trip plan, can be used to determine, predict or infer the current and future coupler state. The force calculations or predictions can be limited to a plurality of cars in the front of the train where the application of tractive effort or braking effort can create the largest coupler forces due to the momentum of the trailing railcars. The forces can also be used to determine, predict or infer the current and future slack states for the entire train or for train segments.

Several methods for calculating the coupler forces and/or inferring or predicting the coupler conditions are described below. The force exerted by two linked couplers on each other can be determined from the individual coupler forces and the slack condition determined from the linked coupler forces. Using this technique, the slack condition for the entire train or for train segments can be determined, predicted or inferred.

Generally, the forces experienced by a railcar are dependent on the forces (traction or braking) exerted by the locomotive at the head end (and by any remote locomotive consists in the train), car mass, car resistance, track profile and air brake forces. The total force on any railcar is a vector sum of a coupler force in the direction of travel, a coupler force opposite the direction of travel and a resistance force (a function of the track grade, car velocity and force exerted by any current air brake application) also opposite the direction of travel.

Further, the rate and direction of coupler force changes indicate changes (transients) in the current slack condition (to a more stretched or to a more bunched state or a transition between states) and indicate a slack event where the train (or segments of the train) switch from a current bunched state to a stretched state or vice versa. The rate of change of the coupler forces and the initial conditions indicate the time at which an impending slack event will occur.

A railcar's coupler forces are functions of the relative motion between coupled railcars in the forward-direction and reverse-direction. The forces on two adjacent railcars indicate the slack condition of the coupler connecting the two railcars. The forces for multiple pairs of adjacent railcars in the train indicate the slack condition throughout the train.

Figure 9:
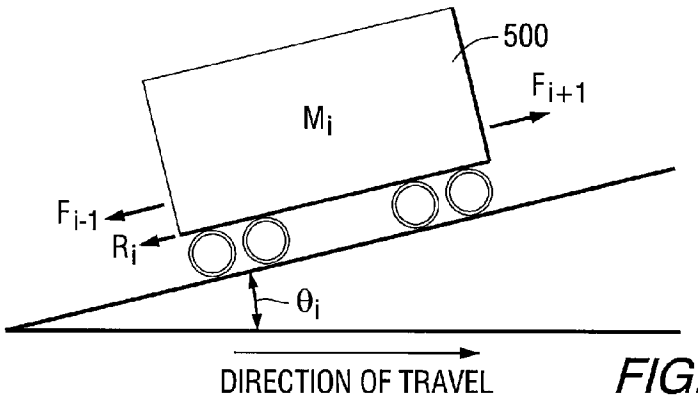
FIG. 9 illustrates forces imposed on a railcar.

A exemplary railcar 500 (the i th railcar of the train) illustrated in FIG. 9 is subject to multiple forces that can be combined to three forces: $F_{i+1}$ (the force exerted by the i+1 railcar), $F_{i-1}$ (the force exerted by the i−1 railcar) and $R_i$ as illustrated in FIG. 9. The slack condition can be determined, inferred or predicted from the sign of these forces and the degree to which the train or a train segment is stretched or bunched can be determined, inferred or predicted from the magnitude of these forces. The forces are related by the following equations.

$$\Sigma F_i = M_i a_i \tag{1}$$

$$F_{i+1} - F_{i-1} - R_i(\theta_i, v_i) = M_i a_i \tag{2}$$

The resistance of the i th car $R_i$ is a function of the grade, railcar velocity and the braking effort as controlled by the airbrake system. The resistance function can be approximated by:

$$R_i(\theta_i, v_i) = M_i g \sin(\theta_i) + A + Bv_i + CV_i^2 + \text{airbrake}(BP_i, BP'_i, v_i, \ldots) \tag{3}$$

where, $R_i$ is the total resistance force on the ith car, $M_i$ is the mass of the ith car, g is the acceleration of gravity, $\theta_i$ is the angle shown in FIG. 9 for the ith car, $v_i$ is the velocity of the ith car, A, B and C are the Davis drag coefficients and BP is the brake pipe pressure (where the three ellipses indicate other parameters that affect the air brake retarding force, e.g., brake pad health, brake efficiency, rail conditions (rail lube, etc), wheel diameter, brake geometry)

The coupler forces $F_{i+1}$ and $F_{i-1}$ are functions of the relative motion between adjacent railcars as defined by the following two equations.

$$F_{i+1} = f(d_{i,i+1}, v_{i,i+1}, a_{i,i+1}, \text{H.O.T.}) \tag{4}$$

$$F_{i-1} = f(d_{i,i-1}, v_{i,i-1}, a_{i,i-1}, \text{H.O.T.}) \tag{5}$$

As is known, in addition to the distance, velocity and acceleration terms shown, in another embodiment the functions can include damping effects and other higher order terms (H.O.T.).

According to one embodiment of the present invention, a force estimation methodology is utilized to determine, predict or infer the train's slack condition from the forces $F_{i+1}$, $F_{i-1}$ and $R_i$. This methodology utilizes the train mass distribution, car length, Davis coefficients, coupler force characteristics, locomotive speed, locomotive tractive effort and the track profile (curves and grades), wind effects, drag, axle resistance, track condition, etc. as indicated in equations (3), (4) and (5), to model the train and determine coupler forces. Since certain parameters may be estimated and others may be ignored (especially parameters that have a small or negligible effect) in the force calculations, the resulting values are regarded as force estimates within some confidence bound.

Figure 8A:
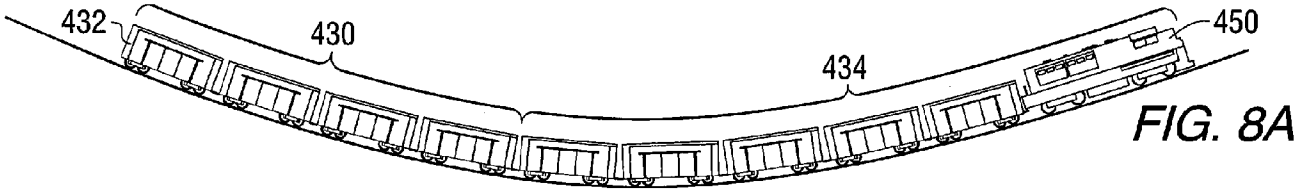
FIGS. 8A and 8B illustrate coupler forces for a railroad train.
Figure 8B:
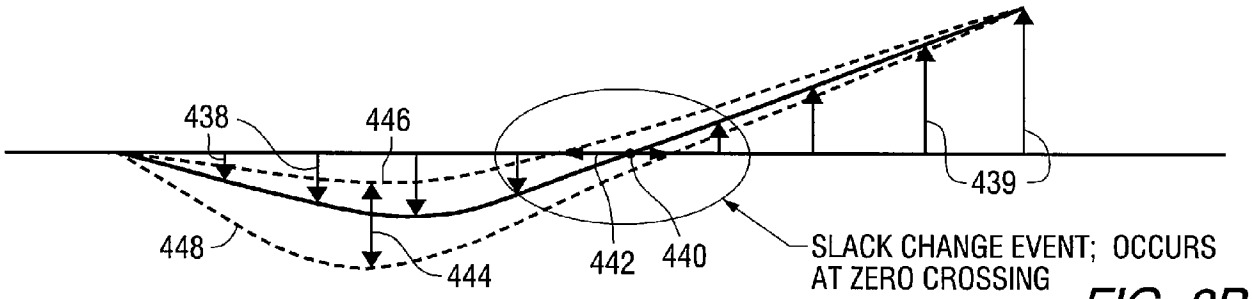

One exemplary illustration of this technique is presented in FIGS. 8A and 8B, where FIG. 8A illustrates a section 430 of a train 432 in a bunched condition and a section 434 in a stretched condition. An indication of the bunched or stretched condition is presented in the graph of FIG. 8B where down-pointing arrowheads 438 indicate a bunched state (negative coupler forces) and up-pointing arrowheads 439 indicate a stretched state (positive coupler forces). A slack change event occurs at a zero crossing 440.

A confidence range represented by a double arrowhead 444 and bounded by dotted lines 446 and 448 is a function of the uncertainty of the parameters and methodology used to determine, predict or infer the slack condition along the train. The confidence associated with the slack transition point 440 is represented by a horizontal arrowhead 442.

The train control system can continuously monitor the acceleration and/or speed of a locomotive consist 450 and compare one or both to a calculated acceleration/speed (according to known parameters such as track grade, TE, drag, speed, etc.) to determine, infer or predict the accuracy of the known parameters and thereby determine, predict or infer the degree of uncertainty associated with the coupler forces and the slack condition. The confidence interval can also be based on the change in track profile (for example, track grade), magnitude and the location of the slack event.

Instead of computing the coupler forces as described above, in another embodiment the sign of the forces imposed on two linked railcars is determined, predicted or inferred and the slack condition determined therefrom. That is, if the force exerted on a front coupler of a first railcar is positive (i.e., the force is in the direction of travel) and the force exerted on the rear coupler of a second railcar linked to the front of the first railcar is negative (i.e., in the opposite direction to the direction of travel), the slack condition between the two railcars is stretched. When both coupler forces are in the opposite direction as above the two railcars are bunched. If all the railcars and the locomotives are bunched (stretched) then the train is bunched (stretched). The force estimation technique described above can be used to determine, predict or infer the signs of the coupler forces.

Both the coupler force magnitudes and the signs of the coupler forces can be used to determine, infer or predict the current stack state for the entire train or for segments of the train. For example, certain train segments can be in a stretched state where the coupler force F>0, and other segments can be in a compressed state where F<0. The continuous slack condition can also be determined, inferred or predicted for the entire train or segments of the train based on the relative magnitude of the average coupler forces.

Determining changes in coupler forces (e.g., a rate of change for a single coupler or the change with respect to distance over two or more couplers) can provide useful train control information. The rate of change of force on a single coupler as a function of time indicates an impending slack event. The higher the rate of change the faster the slack condition will propagate along the train (a run-in or a run-out event). The change in coupler force with respect to distance indicates the severity (i.e., magnitude of the coupler forces) of an occurring slack event.

Figure 4:
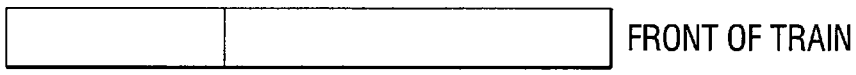

The possibility of an impending slack event, a current slack run-in or run-out event and/or a severity of the current slack event can be displayed to the operator, with or without an indication of the location of the event. For example, the HMI referred to above can show that a slack event in the vicinity of car number 63 with a severity rating of 7. This slack event information can also be displayed in a graphical format as shown in FIG. 4. This graphical indication of a slack event can be represented using absolute distance, car number, relative (percent) distance, absolute tonnage from some reference point (such as the locomotive consist), or relative (percent) tonnage and can formatted according to the severity and/or trend (color indication, flashing, etc.).

Furthermore, additional information about the trend of a current slack event can be displayed to inform the operator if the situation is improving or degrading. The system can also predict, with some confidence bound as above, the effect of increasing or decreasing the current notch command. Thus the operator is given an indication of the trend to be expected if certain notch change action is taken.

The location of slack events, the location trend and the magnitude of coupler forces can also be determined, predicted or inferred by the force estimation method. For a single consist train, the significance of a slack event declines in a direction toward the back of the train because the total car mass declines rearward of the slack event and thus the effects of the slack event are reduced. However, for a train including multiple consists (i.e., lead and non-lead consists), the significance of the slack event at a specific train location declines as the absolute distance to the slack event increases. For example, if a remote consist is in the center of the train, slack events near the front and center are significant slack events relative to the centered remote consist, but slack events three-quarters of the distance to the back of the train and at the end of train are not as significant. The significance of the slack event can be a function solely of distance, or in another embodiment the determination incorporates the train weight distribution by analyzing instead the mass between the consist and the slack event, or a ratio of the mass between the consist and the slack event and the total train mass. The trend of this tonnage can also be used to characterize the current state.

The coupler force signs can also be determined, predicted or inferred by determining the lead locomotive acceleration and the natural acceleration of the train, as further described below.

The coupler force functions set forth in equations (4) and (5) are only piecewise continuous as each includes a dead zone or dead band where the force is zero when the railcars immediately adjacent to the railcars of interest are not exerting any forces on the car of interest. That is, there are no forces transmitted to the i th car by the rest of the train, specifically by the (i+1th) and the (i−1)th railcars. In the dead band region the natural acceleration of the car can be determined, predicted or inferred from the car resistance and the car mass since the railcar is independently rolling on the track. This natural acceleration methodology for determining, predicting or inferring the slack condition avoids calculating the coupler forces as in the force estimation method above. The pertinent equations are $$-R_i(\theta_i, v_i) = M_i a_i \tag{6}$$

$$a_i = \frac{-R_i(\theta_i, v_i)}{M_i} \tag{7}$$

where it is noted by comparing equations (2) and (6) that the force terms $F_{i+1}$, $F_{1-1}$ are absent since the i+1 and the i−1 railcars are not exerting any force on the i th car. The value $a_i$ is the natural acceleration of the i th railcar.

If all the couplers on the train are either stretched, $F_{i+1}$, $F_{i-1}>0$ (the forward and reverse direction forces on any car are greater than zero) or bunched, $F_{i+1}$, $F_{i-1}<0$ (the forward and reverse direction forces on any car are less than zero) then the velocity of all the railcars is substantially the same and the acceleration (defined positive in the direction of travel) of all railcars (denoted the common acceleration) is also substantially the same. If the train is stretched, positive acceleration above the natural acceleration maintains the train in the stretched state. (However negative acceleration does not necessarily mean that the train is not stretched.) Therefore, the train will stay in the stretched (bunched) condition only if the common acceleration is higher (lower) than the natural acceleration at any instant in time for all the individual railcars following the consist where the common acceleration is measured. If the train is simply rolling, the application of TE by the lead consist causes a stretched slack condition if the experienced acceleration is greater than the train's maximum natural acceleration (where the train's natural acceleration is the largest natural acceleration value from among the natural acceleration value of each railcar). As expressed in equation form, where a is the common acceleration, the conditions for fully stretched and fully bunched slack state, respectively, are:

$$a > a_i = \frac{-R_i(\theta_i, v)}{M_i}, \forall i \tag{8}$$

$$a < a_i = \frac{-R_i(\theta_i, v)}{M_i}, \forall i \tag{9}$$

To determine, predict or infer the common acceleration, the acceleration of the lead locomotive is determined and it is inferred that the lead acceleration is substantially equivalent to the acceleration of all the railcars in the train. Thus the lead unit acceleration is the common acceleration. To determine, predict or infer the slack condition at any instant in time, one determines the relationship between the inferred common acceleration and the maximum and minimum natural acceleration from among all of the railcars, recognizing that each car has a different natural acceleration at each instant in time. The equations below determine $a_{max}$ (the largest of the natural acceleration values from among all railcars of the train) and $a_{min}$ (the smallest of the natural acceleration values from among all railcars of the train).

$$a_{\max} = \mathrm{Max}\left(\frac{-R_i(\theta_i, v)}{M_i}\right) \tag{10}$$

$$a_{\min} = \mathrm{Min}\left(\frac{-R_i(\theta_i, v)}{M_i}\right) \tag{11}$$

If the lead unit acceleration (common acceleration) is greater than $a_{max}$ then the train is stretched and if the lead unit acceleration is less than $a_{min}$ then the train is bunched.

Figure 10:
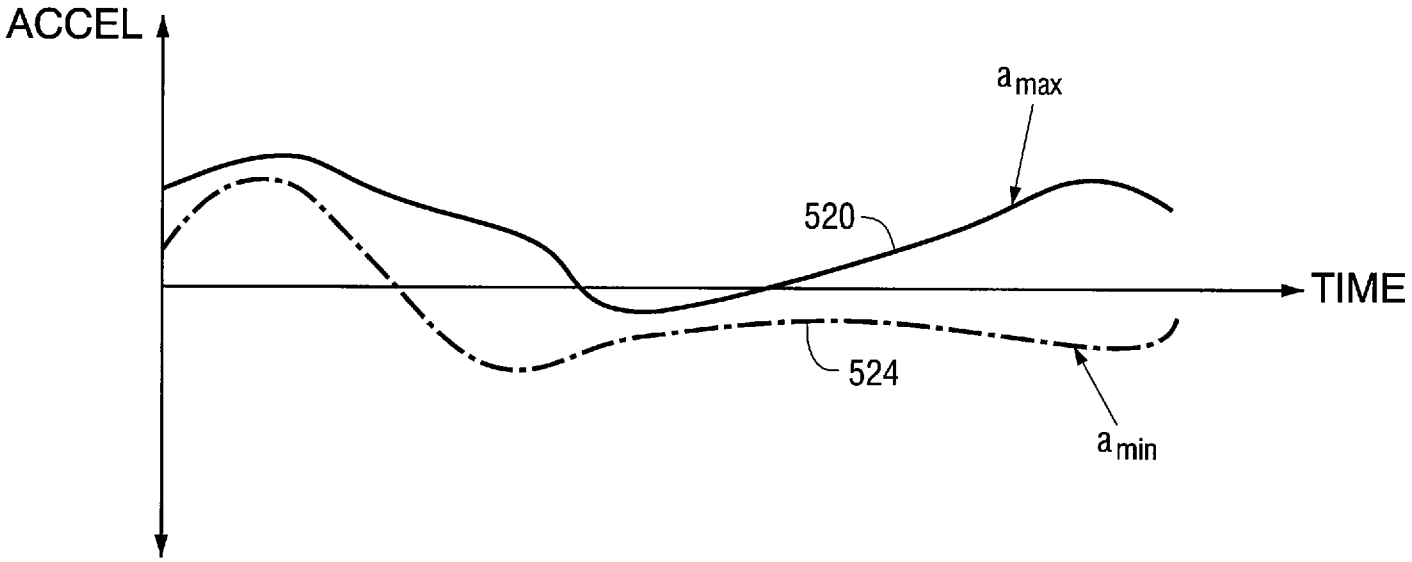
FIG. 10 graphically illustrates minimum and maximum natural railcar accelerations for a railroad train as a function of time.

FIG. 10 illustrates the results from equations (10) and (11) as a function of time, including a curve 520 indicating the maximum natural acceleration from among all the railcars as a function of time and a curve 524 depicting the minimum natural acceleration from among all the railcars as a function of time. The common acceleration of the train, as inferred from the locomotive's acceleration, is overlaid on the FIG. 10 graph. At any time when the common acceleration exceeds the curve 520 the train is in the stretched state. At any time when the common acceleration is less than the curve 524 then the train is in the bunched state. A common acceleration between the curves 520 and 524 indicates an indeterminate state such as the intermediate state 302 of FIG. 1. As applied to a continuous slack condition model as depicted in FIG. 2, the difference between the common acceleration and the corresponding time point on the curves 520 and 524 determines a percent of stretched or a percent of bunched slack state condition.

The minimum and maximum natural accelerations are useful to an operator, even for a train controlled by an automatic train control system, as they represent the accelerations to be attained at that instant to ensure a stretched or bunched state. These accelerations can be displayed as simply numerical values (i.e., x MPH/min) or graphically as a "bouncing ball," plot of the natural accelerations, a plot of minimum and maximum natural accelerations along the track for a period of time ahead, and according to other display depictions, to inform the operator of the stretched (maximum) and bunched (minimum) accelerations.

The plots of FIG. 10 can be generated before the trip begins (if a trip plan has been prepared prior to departure) and the common acceleration of the train (as controlled by the operator or the automatic train control system) used to determine, infer or predict whether the train will be stretched or bunched at a specific location on the track. Similarly, they can be computed and compared en route and updated as deviations from the plan occur.

A confidence range can also be assigned to each of the $a_{max}$ and $a_{min}$ curves of FIG. 8 based on the confidence that the parameters used to determine the natural acceleration of each railcar accurately reflect the actual value of that parameter at any point during the train trip.

When the train's common acceleration is indicated on the FIG. 10 graph, a complete slack transition occurs when common acceleration plot moves from above the curve 520 to below the curve 524, i.e., when the slack condition changes from completely stretched to completely bunched. It is known that a finite time is required for all couplers to change their slack condition (run-in or run-out) after such a transition. It may therefore be desired to delay declaration of a change in slack condition following such a transition to allow all couplers to change state, after which the train is controlled according to the new slack condition.

To predict the slack condition/state, when a train speed profile is known (either a priori based on a planned speed profile or measured in real time) over a given track segment, predicted (or real-time) acceleration is compared to the instantaneous maximum natural acceleration for each railcar at a distance along the track. The instantaneous slack condition can be determined, predicted or inferred when the predicted/actual acceleration differs (in the right direction) from the maximum or the minimum natural accelerations, as defined in equations (10) and (11) above, by more than a predetermined constant. This difference is determined, predicted or inferred as a fixed amount or a percentage as in equations (12) and (13) below. Alternatively, the slack condition is determined, predicted or inferred over a time interval by integrating the difference over the time interval as in equations (14) and (15) below.

$$a_{min} - a_{predicted} > k_1 \tag{12}$$

$$a_{predicted} - a_{max} > k_1 \tag{13}$$

$$\int (a_{min} - a_{predicted})dt > k_2 \tag{14}$$

$$\int (a_{predicted} - a_{max})dt > k_2 \tag{15}$$

The slack condition can also be predicted at some time in the future if the current slack condition, the predicted applied tractive effort (and hence the acceleration), the current speed and the upcoming track profile for the track segment of interest are known.

Knowing the predicted slack condition according to either of the described methods may affect the operator's control of the train such that upcoming slack changes that may cause coupler damage are prevented.

In another embodiment, with knowledge of the current speed (acceleration), past speed and past slack condition, the current or real-time slack condition is determined, predicted or inferred from the train's current track location (track profile) by comparing the actual acceleration (assuming all cars in the train have the same common acceleration) with the minimum and maximum natural accelerations from equations (16) and (17). Knowing the current slack condition allows the operator to control the train in real-time to avoid coupler damage.

$$a_{min}-a_{actual}>k_1 \quad (16)$$

$$a_{actual}-a_{max}>k_1 \quad (17)$$

$$\int(a_{min}-a_{actual})dt>k_2 \quad (18)$$

$$\int(a_{actual}-a_{max})dt>k_2 \quad (19)$$

Also note that $a_{min}$ and $a_{max}$ can be determined, predicted or inferred for any segment of the train used to define multiple slack states as described elsewhere herein. Furthermore, the location of $a_{min}$ and $a_{max}$ in the train can be used to quantify the intermediate slack condition and to assign the control limits.

When the slack condition of the train is known, for example as determined, predicted or inferred according to the processes described herein, the train is controlled (automatically or manually) responsive thereto. Tractive effort can be applied at a higher rate when the train is stretched without damage to the couplers. In an embodiment in which a continuous slack condition is determined, predicted or inferred, the rate at which additional tractive effort is applied is responsive to the extent to which the train is stretched. For example, if the common acceleration is 50% of the maximum natural acceleration, the train can be considered to be in a 50% stretched condition and additional tractive effort can be applied at 50% of the rate at which it would be applied when the common acceleration is greater than the maximum acceleration, i.e., a 100% stretched condition. The confidence is determined by comparing the actual experienced acceleration given TE/speed/location with the calculated natural acceleration as described above.

In a distributed power train (DP train), one or more remote locomotives (or a group of locomotives in a locomotive consist) are remotely controlled from a lead locomotive (or a lead locomotive consist) via a hard-wired or radio communications link. One such radio-based DP communications system is commercially available under the trade designation Locotrol® from the General Electric Company of Fairfield, Conn. and is described in GE's U.S. Pat. No. 4,582,280. Typically, a DP train comprises a lead locomotive consist followed by a first plurality of railcars followed by a non-lead locomotive consist followed by a second plurality of railcars. Alternatively, in a pusher operating mode the non-lead locomotive consist comprises a locomotive consist at the end-of-train position for providing tractive effort as the train ascends a grade.

Figure 11:
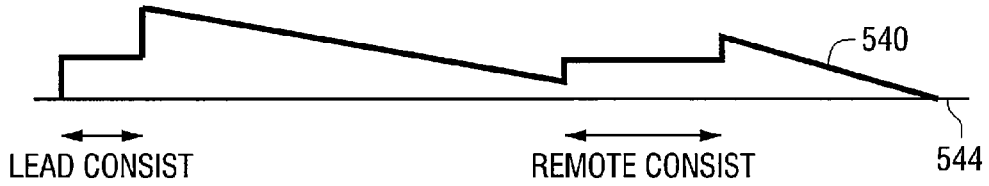
FIGS. 11 and 12 graphically illustrate slack conditions for a distributed power train.

The natural acceleration method described above can be used to determine the slack condition in a DP train. FIG. 11 shows an exemplary slack condition in a DP train. In this case all couplers are in tension (a coupler force line 540 is depicted above a zero line 544, indicating a stretched state for all the railcars couplers). The acceleration as measured at either of the locomotive consists (the head end or lead consist or the remote non-lead consist) is higher than the natural acceleration of any one railcar or blocks of railcars in the entire train, resulting in a stable train control situation.

Figure 12:
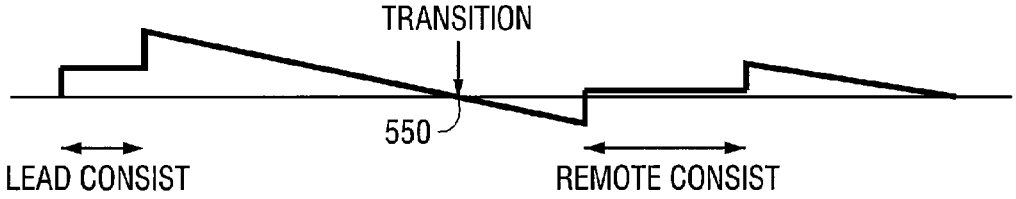
Figure 14:
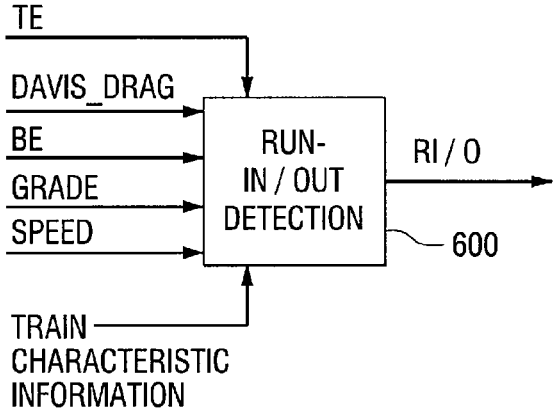
FIG. 14 illustrates the parameters employed to detect slack conditions, including a run-in or run-out condition.

However, a "fully stretched" situation may also exist when the remote locomotive consist is bearing more than just the railcars behind it. FIG. 12 illustrates this scenario. Although all coupler forces are not positive, the acceleration of both locomotive consists is higher than the natural acceleration of the railcars. This is a stable scenario as every railcar is experiencing a net positive force from one locomotive consist or the other. A transition point 550 is a zero force point—often called the "node," where the train effectively becomes two trains with the lead locomotive consist seeing the mass of the train from the head end to the transition point 550 and the remote locomotive consist seeing the remaining mass to the end of the train. This transition point can be nominally determined if the lead and remote locomotive consist acceleration, tractive effort and the track grade are known. If the acceleration is unknown, it can be assumed that the system is presently stable (i.e., the slack condition is not changing) and that the lead and remote locomotive consist accelerations are identical.

In this way, multiple slack states along the train (that is, for different railcar groups or sub-trains) can be identified and the train controlled responsive to the most restrictive sub-state in the train (i.e., the least stable slack state associated with one of the sub-trains) to stabilize the least restrictive state. Such control may be exercised by application of tractive effort or braking effort by the locomotive consist forward of the sub-train having the less stable state or the locomotive consist forward of the sub-train having the more stable state.

Alternatively a combination of the two states can be used to control the train depending on the fraction of the mass (or another train/sub-train characteristic such as length) in each sub-train. The above methods can be employed to further determine these sub-states within the train and similar strategies for train control can be implemented. The determined states of the train and sub-trains can also be displayed for the operators use in determining train control actions. In an application to an automatic train control system, the determined states are input to the train control system for use in determining train control actions for the train and the sub-trains.

When given the option of changing power levels (or braking levels) at one of the consists, responsive to a need to change the train's tractive (or braking) effort, preference should be given to the consist connected to the train section (sub-train) having the most stable slack condition. It is assumed in this situation that all other constraints on train operation, such as load balancing, are maintained.

When a total power level change is not currently required, the power can be shifted from one consist to the other for load balancing. Typically the shift involves a tractive effort shift from the consist controlling the most stable sub-train to the consist controlling the least stable sub-train, depending on the power margin available. The amount of power shifted from one consist to the other may be accomplished by calculating the average track grade or equivalent grade taking into account the weight or weight distribution of the two or more subtrains and distributing the applied power responsive to the ratio of the weight or weight distribution. Alternatively, the power can be shifted from the consist connected to the most stable sub-train to the consist connected to the least stable sub-train as long as the stability of the former is not comprised.

In addition to the aforementioned control strategies, it is desired to control the motion of the transition point 550 in the train. As this point moves forward or backward in the train, localized transient forces are present as this point moves from one railcar to an adjacent railcar. If this motion is rapid, these forces can become excessive and can cause railcar and coupler damage. The tractive effort of either consist can be controlled such that this point moves no faster than a predetermined maximum speed. Similarly, the speed of each consist can be controlled such that the distance between the lead and the remote locomotive consists does not change rapidly.

In addition to the above mentioned algorithms and strategies, in another embodiment instead of analyzing an individual railcar and making an assessment of the train state and associated allowable control actions, similar results may be derived by looking at only portions of the train or the train in its entirety.

For example, the above natural acceleration method may be restricted to looking at the average grade over several railcar lengths and using that data with the sum drag to determine a natural acceleration for this block of cars. This embodiment reduces computational complexity while maintaining the basic conceptual intent.

Although various techniques for predicting the slack condition have been described herein, certain ones of the variables that contribute to the prediction are continually in flux, such as Davis drag coefficients, track grade database error, rail/bearing friction, airbrake force, etc. To overcome the effects of these variations, another embodiment of the invention monitors axle jerk (i.e., the rate of change of the acceleration) to detect a slack run-in (rapid slack condition change from stretched to bunched) and a slack run-out (rapid slack condition change from bunched to stretched). The run-in/run-out occurs when an abrupt external force acts on the lead consist, resulting in a high rate of change of the acceleration in time.

This reactive method of one embodiment determines, predicts or infers a change in the slack condition by determining the rate of change of one or more locomotive axle accelerations (referred to as jerk, which is a derivative of acceleration with time) compared with an applied axle torque. Slack action is indicated when the measured jerk is inconsistent with changes in applied torque due to the application of TE or BE, i.e, the actual jerk exceeds the expected jerk by some threshold. The sign of the jerk (denoting a positive or a negative change in acceleration as a function of time) is indicative of the type of slack event, i.e., a run-in or a run-out. If the current slack condition is known (or had been predicted) then the new slack condition caused by the jerk can be determined.

The system of one embodiment monitors jerk and establishes acceptable upper and lower limits based on the train characteristics, such as mass (including the total mass and the mass distribution), length, consist, power level, track grade, etc. The upper and lower limits change with time as the train characteristics and track conditions change. Any measured time derivative of acceleration (jerk) beyond these limits indicates a run-in or run-out condition and can be flagged or indicated accordingly for use by the operator (or an automatic train control system) to properly control the train.

If the train is not experiencing an overspeed condition when the jerk is detected, in one embodiment the train is controlled to hold current power or tractive effort output for some period of time or travel distance to allow the train to stabilize without further perturbations. Another operational option is to limit the added power application rate to a planned power application rate. For example if an advisory control system is controlling the locomotive and executing to an established plan speed and plan power, the system continues to follow the planned power but is precluded from rapidly compensating to maintain the planned speed during this time. The intent is therefore to maintain the macro-level control plan without unduly exciting the system. However, should an overspeed condition occur at any time, it will take precedence over the hold power strategy to limit the run-in/out effects.

Figure 13:
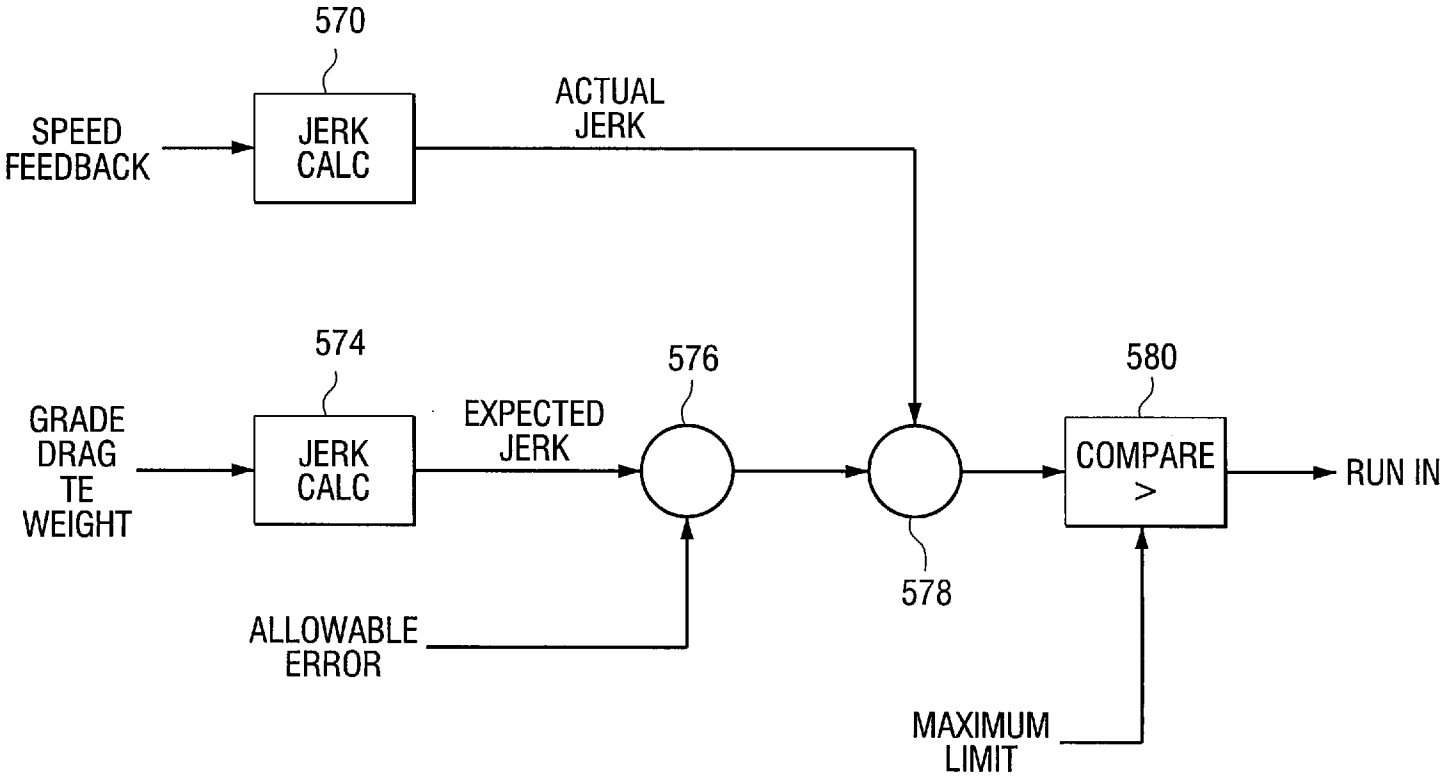
FIG. 13 illustrates a block diagram of elements for determining a reactive jerk condition.

FIG. 13 illustrates one embodiment for determining a run-in condition. Similar functional elements are employed to determine a run-out condition. Train speed information is input to a jerk calculator 570 for determining a rate of change of acceleration (or jerk) actually being experienced by a vehicle in any train segment.

Train movement and characteristic parameters are input to a jerk estimator 574 for producing a value representative of an expected jerk condition similar to the actual jerk being calculated in 570. A summer 576 combines the value from the estimator 574 with an allowable error value. The allowable error depends on the train parameters and the confidence of the estimation of expected jerk. The output of the summer 576 represents the maximum expected jerk at that time. Element 578 calculates the difference between this maximum expected jerk and the actual jerk being experienced as calculated by the element 570. The output of this element represents the difference/error between the actual and the maximum expected jerk.

A comparator 580 compares this difference with the maximum limit of allowed jerk error. The maximum limit allowed can also depend on the train parameters. e. If the difference in jerk is greater than the maximum allowed limit, a run-in condition is declared. Comparator 580 can also include a time persistence function also. In this case the condition has to persist for a predetermined period of time (example 0.5 second) to determine a run in condition. Instead of rate of change of acceleration being compared, the actual acceleration could be used to compare as well. Another method includes the comparison of detector like accelerometer or a strain gauge on the coupler or platform with the expected value calculated in a similar manner. A similar function is used for run out detector.

In a train including multiple (lead and trailing) locomotives in the lead consist, the information from the trailing locomotives can be used advantageously to detect slack events. Monitoring the axle jerk (as described above) at the trailing locomotive in the consist, allows detection of slack events where the coupler forces are highest and thus the slack action most easily detectable.

Also, knowing the total consist tractive or braking effort improves the accuracy of all force calculations, parameter estimations, etc. in the equations and methodologies set forth herein. Slack action within the locomotive consist can be detected by determining, predicting or inferring differences in acceleration between the consist locomotives. The multiple axles in a multiple consist train (a distributed power train) also provide additional points to measure the axle jerk from which the slack condition can be determined.

FIG. 13 illustrates a slack condition detector or run-in/run-out detector 600 receiving various train operating and characteristic (e.g., static) parameters from which the slack condition (including a run-in or a run-out condition) is determined. Various described embodiments employ different algorithms, processes and input parameters to determine the slack condition as described herein.

In a train having multiple locomotive consists (such as a distributed power train), slack condition information can be determined, predicted or inferred from a difference between the speed of any two of the consists over time. The slack condition between two locomotive consists can be determined, predicted or inferred from the equation.

$$\int(v_{consist_1}-v_{consist_2})dt \tag{20}$$

Changes in this distance (resulting from changes in the relative speed of the consists) indicate changes in the slack condition. If the speed difference is substantially zero, then the slack condition remains unchanged. If the coupler characteristics are not known a priori, they can be determined, predicted or inferred based on the steady state tractive effort and distance between locomotive consists.

If the distance between the two consists is increasing the train is moving toward a stretched condition. Conversely, if the distance is decreasing the train is moving toward a bunched condition. Knowledge of the slack condition before calculating the value in equation (20) indicates a slack condition change.

For a train with multiple locomotive consists, the slack condition can be determined, predicted or inferred for train segments (referred to as sub trains, and including the trailing railcars at the end of the train) that are bounded by a locomotive consist, since it is known that different sections of the train may experience different slack conditions.

For a train having an end-of-train device, the relative speed between the end of train device and the lead locomotive (or between the end of train device and any of the remote locomotive consists) determines the distance between therebetween according to the equation $$\int(v_{consist}-v_{EOT})dt \tag{21}$$

Changes in this distance indicate changes in the slack condition.

In another embodiment the grade the train is traversing can be determined to indicate the train slack condition. Further, the current acceleration, drag and other external forces that affect the slack condition can be converted into an equivalent grade parameter, and the slack condition determined from that parameter. For example, while a train is traversing flat, tangent track, a force due to drag resistance is still present. This drag force can be considered as an effective positive grade without a drag force. It is desired to combine all the external forces on each car (e.g., grade, drag, acceleration) (i.e., except forces due to the track configuration where such track configuration forces are due to track grade, track profile, track curves, etc.), such into a single "effective grade" (or equivalent grade) force. Summing the effective grade and the actual grade determines the net effect on the train state. Integrating the equivalent grade from the rear of the train to the front of the train as a function of distance can determine where slack will develop by observing any points close to or crossing over zero. This qualitative assessment of the slack forces may be a sufficient basis for indicating where slack action can be expected. The equivalent grade can also be modified to account for other irregularities such as non-uniform train weight.

Once the slack condition is known, estimated, or known to be within certain bounds (either a discrete state of FIG. 1 or a slack condition on the curve 318 of FIG. 2), according to the various techniques described herein, a numerical value, qualitative indication or a range of values representing the slack condition are supplied to the operator (including an automatic train control system) for generating commands that control train speed, apply tractive effort or braking effort at each locomotive or within a locomotive consist to ensure that excessive coupler forces are not generated. See FIG. 7, where a block 419 indicates that the operator is advised of the slack condition for operating (as indicated by the dashed lines) the tractive effort controller or the braking effort controller responsive thereto. Any of the various display formats described herein can be used to provide the information. In a train operated by an automotive train control system, the block 415 represents the automatic train control system.

In addition to controlling the TE and BE, the slew rates for tractive effort changes and braking effort changes, and dwell times for tractive effort notch positions and for brake applications can also controlled according to the slack condition. Limits on these parameters can be displayed to the operator as suggested handling practices given the current slack condition of the train. For example, if the operator had recently changed notch, the system could display a "Hold Notch" recommendation for x seconds, responsive to the current slack condition. The specified period of time would correspond to the recommended slew rate based on the current slack condition. Similarly, the system can display the recommended acceleration limits for the current train slack condition and notify the operator when these limits were exceeded.

The operator or the automatic train control system can also control the train to achieve desired slack conditions (as a function of track condition and location) by learning from past operator behavior. For example, the locomotive can be controlled by the application of proper tractive effort and/or braking effort to keep the train in a stretched or bunched condition at a track location where a certain slack condition is desired. Conversely, application of dynamic brakes among all locomotives in the train or independent dynamic brake application among some locomotives can gather the slack at certain locations. These locations can be marked in a track database.

In yet another embodiment, prior train operations over a track network segment can be used to determine train handling difficulties encountered during the trip. This resulting information is stored in a data base for later use by trains traversing the same segment, allowing these later trains to control the application of TE and BE to avoid train handling difficulties.

The train control system can permit operator input of a desired slack condition or coupler characteristics (e.g., stiff couplers) and generate a trip plan to achieve the desired slack condition. Manual operator actions can also achieve the desired slack condition according to any of the techniques described above.

Input data for use in the coupler slack and train handling algorithms and equations described above (which can be executed either on the train or at a dispatch center) can be provided by a manual data transfer from off-board equipment such as from a local, regional or global dispatch center to the train for on-board implementation. If the algorithms are executed in wayside equipment, the necessary data can be transferred thereto by passing trains or via a dispatch center.

The data transfer can also be performed automatically using off-board, on-board or wayside computer and data transfer equipment. Any combination of manual data transfer and automatic data transfer with computer implementation anywhere in the rail network can be accommodated according to the teachings of the embodiments of the present invention.

The algorithms and techniques described herein for determining the slack condition can be provided as inputs to a trip optimization algorithm to prepare an optimized trip plan that considers the slack conditions and minimizes in-train forces.

The algorithms can also be used to post-process a plan (regardless of its optimality) or can be executed in real time.

The various embodiments of the invention employ different devices for determining or measuring train characteristics (e.g., relatively constant train make-up parameters such as mass, mass distribution, length) and train movement parameters (e.g., speed, acceleration) from which the slack condition can be determined as described. Such devices can include, for example, one or more of the following: sensors (e.g., for determining force, separation distance, track profile, location, speed, acceleration, TE and BE) manually input data (e.g., weight data as manually input by the operator) and predicted information, Although certain techniques and mathematical equations are set forth herein for determining, predicting and/or inferring parameters related to the slack condition of the train and train segments, and determining, predicting or inferring the slack condition therefrom, the embodiments of the invention are not limited to the disclosed techniques and equations, but instead encompass other techniques and equations known to those skilled in the art.

One skilled in the art recognizes that simplifications and reductions may be possible in representing train parameters, such as grade, drag, etc. and in implementing the equations set forth herein. Thus the embodiments of the invention are not limited to the disclosed techniques, but also encompass simplifications and reductions for the data parameters and equations.

The embodiments of the present invention contemplate multiple options for the host processor computing the slack information, including processing the algorithm on the locomotive of the train within wayside equipment, off-board (in a dispatch-centric model) or at another location on the rail network. Execution can be prescheduled, processed in real time or driven by an designated event such as a change in train or locomotive operating parameters, that is operating parameters related to either the train of interest or other trains that may be intercepted by the train of interest.

The methods and apparatus of the invention embodiments provide coupler condition information for use in controlling the train. Since the techniques of the invention embodiments are scalable, they can provide an immediate rail network benefit even if not implemented throughout the network. Local tradeoffs can also be considered without the necessity of considering the entire network.

This written description uses examples to disclose the various embodiments of the invention, including the best mode, and also to enable any person skilled in the art to make and use the invention. The patentable scope of the invention is defined by the claims and may include other examples that occur to those skilled in the art. Such other examples are intended to be within the scope of the claims if they have structural elements that do not differ from the literal language of the claims or if they include equivalent structural elements with insubstantial differences from the literal languages of the claims.

What is claimed is:

1. An apparatus for controlling a railway system, comprising:

a first element configured to determine slack between segments of the railway system as the railway system travels along a track the segments including one or more powered units or non-powered units, the slack determined from a comparison between a maximum natural acceleration and a minimum natural acceleration of one or more of the non-powered units of the railway system and with a common acceleration of the railway system, the common acceleration of the railway system determined from acceleration of a lead powered unit of the one or more powered units in the railway system; and a second element configured to control application of one or more of tractive effort or braking effort based on the slack that is determined such that actual coupler forces that actually occur between the segments of the railway system during travel of the railway system along the track are within designated limits.

2. The apparatus of claim 1 wherein the railway system comprises a rail vehicle traversing a rail network that includes the track, and further comprising a third element configured to control application of one or more of the tractive effort or a rate of change of the tractive effort by one or more of the powered units of the railway system in response to the coupler forces being within the designated limits.

3. The apparatus of claim 2 wherein the one or more powered units include a locomotive and the one or more non-powered units include a railcar, and wherein the first element is configured to control the application of the one or more of tractive effort or braking effort to maintain a current slack condition of the rail vehicle.

4. The apparatus of claim 3 wherein the third element is configured to control the application of the tractive effort responsive to a location of a change in the coupler forces and to one or more of: a location of the rail vehicle on the rail network, a mass of the rail vehicle, a mass distribution of the rail vehicle, the location of the change in the coupler forces relative to the mass distribution of the rail vehicle, or a mass of the rail vehicle between the location of the change in the coupler forces and the one or more powered units and another force developed by the change in the coupler forces.

5. The apparatus of claim 1 further comprising a third element configured to control application of one or more of the tractive effort or a rate of change of tractive effort of the railway system for a time interval that is based on the slack that is determined.

6. The apparatus of claim 1 further comprising a third element configured to control application of one or more of the tractive effort or a rate of change of tractive effort of the railway system to control a speed of the railway system based on the slack that is determined.

7. The apparatus of claim 1 further comprising a third element configured to control application of one or more of the tractive effort or a rate of change of tractive effort of the railway system based on a force threshold.

8. The apparatus of claim 7 wherein the third element is configured to modify the force threshold according to a sensitivity factor that limits allowable rates of change in one or more of the tractive effort or the braking effort.

9. The apparatus of claim 1 wherein the one or more powered units of the railway system comprise plural spaced apart locomotives, and wherein the first element is configured to determine a change in the actual coupler forces relative to the spaced apart locomotives, and further comprising a third element configured to control application of one or more of the tractive effort or a rate of change of tractive effort of the railway system, wherein the third element is configured to control the application of the tractive effort at one or more of the spaced apart locomotives based on a magnitude of a force exerted on the one or more of the spaced apart locomotives caused by the change in the coupler forces.

10. The apparatus of claim 1 wherein the railway system comprises a rail vehicle, the one or more powered units comprising a lead locomotive and one or more remote locomotives, and wherein the segments of the railway system are bounded by the lead locomotive and the one or more remote locomotives.

11. The apparatus of claim 1 wherein the railway system comprises a rail vehicle traversing a rail network, further comprising a third element configured to control an amount of acceleration and deceleration applied to the rail vehicle based on the slack that is determined.

12. The apparatus of claim 1 further comprising a third element configured to control application of one or more of the tractive effort or a rate of change of tractive effort of the railway system based on a range of uncertainty in the slack that is determined.

13. The apparatus of claim 12 wherein the first element is configured to determine an assumed slack condition responsive to assumed movement parameters of the railway system and the coupler forces as an actual slack condition responsive to actual movement parameters, and wherein the range of uncertainty is based on a relationship between the assumed movement parameters and the actual movement parameters.

14. The apparatus of claim 1 wherein the first element is configured to determine the coupler forces based on characteristics of plural couplers linking railcars and locomotives in the railway system, and further comprising a third element configured to control application of one or more of the tractive effort or a rate of change of tractive effort of the railway system based on one or more of coupler force limits, a coupler dead band, or a coupler spring constant.

15. The apparatus of claim 1 wherein the coupler forces are representative of a bunched, stretched, or intermediate slack condition in the railway system.

16. The apparatus of claim 1 wherein the coupler forces are representative of a slack condition selected from a plurality of discrete slack states associated with different thresholds.

17. The apparatus of claim 1 wherein the coupler forces are representative of a slack condition selected from a continuum of slack conditions between a bunched state, an intermediate state, and a stretched state.

18. The apparatus of claim 1 further comprising a third element configured to limit manually input changes to the tractive effort from a human operator of the railway system based on the slack that is determined.

19. The apparatus of claim 1 further comprising an automatic train control system configured to automatically control application of one or more of the tractive effort or a rate of change of tractive effort of the railway system based on the slack that is determined.

20. The apparatus of claim 1 wherein the railway system is configured to be manually controlled by an operator, and further comprising an advisory control system configured to provide advisory tractive effort applications to the operator based on the slack that is determined.

21. The apparatus of claim 1 further comprising a third element configured to be manually operated by an operator of the railway system to control application of the tractive effort.

22. The apparatus of claim 1 wherein the first element is configured to determine the slack responsive to one or more of a distributed system weight, a track profile, a track grade, environmental conditions, route friction, wind velocity, wind direction, applied tractive effort, applied braking effort, brake pipe pressure, historical tractive effort, historical braking effort, railway system speed, railway system acceleration, application of a friction-modifying substance to a route, isolation of the one or more powered units, or flange lubrication applications.

23. The apparatus of claim 1 wherein the first element is configured to determine the slack for plural couplers disposed between a subset of the segments of the railway system.

24. The apparatus of claim 1 wherein the coupler forces comprise one or more changes in the slack or a transient coupler force, and wherein the first element is further configured to determine one or more of a severity of the change in the slack, a location in the railway system of the change in the slack, or a severity of the transient coupler force.

25. The apparatus of claim 24 further comprising a display configured to present information regarding the change in the slack that is determined.

26. The apparatus of claim 24 further comprising a third element configured to control application of the one or more of the tractive effort or the braking effort responsive to one or more of the severity of the change in the slack, the location of the change in the slack, or the severity of the transient coupler force.

27. The apparatus of claim 1 wherein the one or more powered units include a locomotive, and wherein the first element is configured to determine a severity of a change in the slack that is based on a distance of the change in the slack from the locomotive or based on a tonnage in the railway system between the locomotive and a location of the change in the slack.

28. The apparatus of claim 1 wherein the one or more powered units include a locomotive, and wherein the first element is configured to determine a rate of change in one or more locations of the slack relative to a location of the locomotive.

29. The apparatus of claim 1 wherein the one or more non-powered units include railcars, and wherein the first element is configured to determine railcar tonnage that experiences a change in the slack that is determined or that comprises a rate at which the railcar tonnage experiences a change in the slack.

30. The apparatus of claim 1 further comprising a third element configured to predict a response of the slack to the application of one or more of the tractive effort or the braking effort.

31. The apparatus of claim 1 further comprising a third element configured to control the application of one or more of the tractive effort or a rate of change of the tractive effort based on changes in the slack that is determined.

32. The apparatus of claim 1 further comprising a third element configured to control application of one or more of the tractive effort or a rate of change of tractive effort based on an acceleration limit or a deceleration limit that is based on the slack that is determined.

33. The apparatus of claim 1 further comprising a third element configured to maintain one or more of a tractive effort application or a braking effort application for a predetermined time based on the slack that is determined.

34. The apparatus of claim 1 further comprising a third element configured to control application of the tractive effort according to a current transient slack condition as determined by the first element and that is based on the slack that is determined.

35. The apparatus of claim 34 wherein the third element is configured to maintain the application of the tractive effort for a determined time interval, and the third element is configured to apply a different tractive effort after the determined time interval.

36. The apparatus of claim 1 wherein the first element is further configured to determine one or more of a location or a severity of a change in the slack that is determined.

37. The apparatus of claim 36 wherein the railway system comprises a plurality of railcars and the location comprises one or more of a railcar number or a tonnage between the location of the change in the slack that is determined and another location on the railway system.

38. The apparatus of claim 1 further comprising an automatic control system configured to override application of the tractive effort as commanded by an operator based on the slack that is determined.

39. The apparatus of claim 1 wherein the first element is configured to be controlled by an operator of the railway system in order to modify factors employed by the first element for use in determining the slack that is determined.

40. The apparatus of claim 1 further comprising a third element configured to control application of the tractive effort to achieve a desired slack condition as determined by the first element.

41. The apparatus of claim 1 wherein the slack that is determined represents one or more of a run-in event or a run-out event.

42. The apparatus of claim 1 further comprising a third element configured to control application of one or more of the tractive effort or a rate of change of tractive effort of the railway system and is configured to be controlled by an operator of the railway system in order to manually override the application of the tractive effort by the third element.

43. The apparatus of claim 1 further comprising a third element configured to control application of one or more of the tractive effort or a rate of change of tractive effort of the railway system and to permit an operator of the railway system to manually control application of the tractive effort independent of the slack that is determined.

44. The apparatus of claim 1 wherein the first element is configured to determine the slack based on measured railway system characteristic parameters.

45. The apparatus of claim 1 wherein the first element is configured to determine the slack based on predicted railway system characteristic parameters.

46. The apparatus of claim 1 wherein the first element is configured to receive railway system characteristic parameters from an operator of the railway system and to determine the slack based on the railway system characteristic parameters.

47. The apparatus of claim 1 wherein the railway system comprises a rail vehicle, and wherein the first element is configured to determine the slack at one or more forward locations disposed ahead of a current location of the rail vehicle as the rail vehicle is moving along the track, the first element also configured to determine the slack responsive to one or more of a current actual slack condition, railway system characteristics, a track profile, coupler characteristics, rail vehicle characteristics, or planned applications of tractive and braking efforts to the one or more forward locations.

48. The apparatus of claim 1 wherein the second element is configured to control the application of one or more of the tractive effort or the braking effort to achieve a desired slack at forward route location ahead of a current location of the railway system based on the slack that is determined.

49. The apparatus of claim 48 wherein the desired slack is one or more of supplied from a database or is supplied by an operator of the railway system.

50. The apparatus of claim 1 further comprising an automatic train control system configured to control application of one or more of the tractive effort or a rate of change of tractive effort of the railway system based on a signal indicating the slack that is determined.

51. The apparatus of claim 1 further comprising a third element configured to provide a railway system operator with one or more of a visual or aural indication of the slack that is determined.

52. The apparatus of claim 51 wherein the third element comprises a visual display.

53. The apparatus of claim 51 wherein the third element is configured to provide an audio warning representative of the slack that is determined.

54. The apparatus of claim 51 wherein the third element is configured to provide an indication of the slack that is determined for the railway system or for the segments of the railway system.

55. The apparatus of claim 51 wherein the third element comprises a display configured to provide a textual indication of the slack that is determined for the railway system or for the segments of the railway system.

56. The apparatus of claim 51 wherein the visual indication of the slack that is determined comprises an indication of a bunched, stretched, or intermediate slack state for the railway system or for the segments of the railway system, or the visual indication comprises an indication of a continuum of predicted slack conditions for the railway system or for segments of the railway system.

57. The apparatus of claim 51 wherein the third element is configured to provide one or more of a graphical or a textual indication of the slack that is determined and one or more of a percent of the railway system in a current designated slack condition, a percent of the railway system that is expected to be in a future designated slack condition, a number of the segments of the railway system in a current designated slack condition, a number of the segments of the railway system that are expected to be in a future designated slack condition, a tonnage of the railway system in a current designated slack condition, or a tonnage of the railway system that is predicted to be in a future designated slack condition.

58. The apparatus of claim 51 further comprising a fourth element configured to predict a response of the one or more predicted slack conditions to the application of the tractive effort by the railway system, and wherein the third element is configured to provide a railway system operator with an indication of the response that is predicted.

59. The apparatus of claim 51 further comprising a fourth element configured to control application of one or more of the tractive effort or a rate of change of tractive effort of the railway system responsive to an acceleration limit or to control application of braking effort responsive to deceleration limit, the acceleration limit and the deceleration limit based on the slack that is determined.

60. The apparatus of claim 59 wherein the fourth element is configured to provide a visual or aural indicia when the acceleration limit or the deceleration limit is exceeded by the application of the tractive effort.

61. The apparatus of claim 51 further comprising a fourth element configured to control application of one or more of the tractive effort or a rate of change of tractive effort of the railway system and to maintain the application of tractive effort for a predetermined time based on the slack that is determined.

62. The apparatus of claim 51 wherein the first element is further configured to determine one or more of a location of a slack event, one or more other forces associated with the slack event, or a severity of an impending slack event, and the third element is configured to indicate the location, the one or more other forces, or the severity.

63. The apparatus of claim 62 wherein the one or more non-powered units includes a plurality of railcars and the location of the slack event comprises a railcar number or a tonnage between the location of the impending slack condition and another location on the railway system, and the third element is configured to provide an indication of the railcar number or the tonnage.

64. The apparatus of claim 51 wherein the railway system comprises a lead locomotive consist and a non-lead locomotive consist and one or more railcars, and the third element is configured to provide an indication of the slack that is determined for one or more of the railcars between the lead locomotive consist and the non-lead locomotive consist, and further comprising a fourth element configured to provide an indication of an additional slack condition of one or more of the railcars trailing the non-lead locomotive consist.

65. The apparatus of claim 51 wherein the railway system comprises a locomotive and a railcar, and wherein the first element is configured to determine the slack responsive to a detected change in velocity with respect to one or more of time or a detected change in acceleration with respect to time of the locomotive or of the railcar, and further comprising an indicating element configured to provide a visual or aural indication of the slack that is determined and changes in the slack that is determined responsive to one or more of the detected change in velocity or the detected change in acceleration.

66. The apparatus of claim 51 wherein slack that is determined includes one or more of a run-in or a run-out slack condition.

67. The apparatus of claim 66 wherein the third element is configured to provide an indication of a location of the one or more of the run-in or the run-out slack condition on the railway system.

68. The apparatus of claim 51 wherein the third element is configured to display a representation of the railway system and an indication of the slack that is determined at one or more locations in the railway system.

69. The apparatus of claim 68 wherein the slack that is determined comprises one or more slack conditions for one or more subsets of the segments of the railway system.

70. The apparatus of claim 51 wherein the third element is configured to indicate a location in the railway system where a transient slack condition is identified.

71. The apparatus of claim 1 further comprising a third element configured to provide a railway system operator with one or more of a visual or aural advisory to apply tractive effort responsive to the slack that is determined.

72. The apparatus of claim 1, wherein the natural acceleration represents actual acceleration of the one or more segments of the railway system and the common acceleration represents an acceleration of the railway system.

73. An apparatus for controlling a railway system, comprising:

a first element configured to determine a slack condition between segments of the railway system, each of the segments including one or more powered units or non-powered units, the first element configured to determine the slack condition from a comparison between a maximum natural acceleration and a minimum natural acceleration of one or more of the segments with acceleration of a lead powered unit of the one or more powered units;

a second element configured to control movement of the railway system based on the slack condition based on the slack condition such that actual coupler forces that actually occur between the segments of the railway system remain within designated limits; and a third element configured to control application and a rate of change of one or more of tractive effort or a rate of change of tractive effort provided by one or more of the powered units of the railway system based on the slack condition, the third element configured to control the application and the rate of change of the one or more of the tractive effort or the rate of change of tractive effort in order to maintain the actual coupler forces within limits.

74. The apparatus of claim 73, wherein the third element is configured to control the application and the rate of change of the one or more of the tractive effort or the rate of change of tractive effort to maintain the actual coupler forces within limits by increasing how quickly the application of tractive effort is reduced responsive to the slack condition representing a bunched state.

75. The apparatus of claim 73, wherein the third element is configured to control the application and the rate of change of the tractive effort to maintain the actual coupler forces within limits by limiting how quickly a throttle setting is reduced responsive to the slack condition representing a stretched state.

76. The apparatus of claim 73, wherein the first element is configured to identify increased transitions in the slack condition of the railway system at one or more locations along a track using the slack condition that is determined, and further comprising a display that configured to notify an operator of the railway system of an upcoming location where reduced train handling is anticipated based on the increased transitions in the slack condition that are identified.

* * * * *